US006712665B2

(12) United States Patent
Fushimi et al.

(10) Patent No.: US 6,712,665 B2
(45) Date of Patent: Mar. 30, 2004

(54) METHOD OF MANUFACTURING AN IMAGE FORMING APPARATUS HAVING IMPROVED SPACERS

(75) Inventors: Masahiro Fushimi, Zama (JP); Kunihiro Sakai, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/293,322

(22) Filed: Nov. 14, 2002

(65) Prior Publication Data

US 2003/0124945 A1 Jul. 3, 2003

Related U.S. Application Data

(62) Division of application No. 09/301,583, filed on Apr. 29, 1999, now Pat. No. 6,506,087.

(30) Foreign Application Priority Data

May 1, 1998 (JP) ..... 10-122530

(51) Int. Cl.[7] ..... H01J 9/00; H01J 9/24

(52) U.S. Cl. ..... 445/24; 445/25; 225/2; 234/1; 234/2; 234/3

(58) Field of Search ..... 445/23, 24, 25; 313/495, 292; 234/1, 2, 3, 47; 83/875, 917, 30, 40, 41; 225/2

(56) References Cited

U.S. PATENT DOCUMENTS

| | | | | |
|---|---|---|---|---|
| 3,921,873 A | * | 11/1975 | Dahlberg et al. | 225/2 |
| 4,524,894 A | * | 6/1985 | Leblond | 225/2 |
| 4,904,895 A | | 2/1990 | Tsukamoto et al. | 313/336 |
| 5,066,883 A | | 11/1991 | Yoshioka et al. | 313/309 |
| 5,107,112 A | | 4/1992 | Yanagisawa et al. | 250/306 |
| 5,133,491 A | * | 7/1992 | Correll et al. | 225/1 |

(List continued on next page.)

FOREIGN PATENT DOCUMENTS

| | | |
|---|---|---|
| EP | 0 616 354 A2 | 9/1994 |
| EP | 0 814 491 A2 | 12/1997 |
| JP | 58-016433 | 1/1983 |
| JP | 63-274047 | 11/1988 |
| JP | 01-031332 | 2/1989 |
| JP | 02-257551 | 10/1990 |
| JP | 03-055738 | 3/1991 |
| JP | 04-028137 | 1/1992 |
| JP | 08-180821 | 7/1996 |
| JP | 08-241049 | 9/1996 |
| JP | 08-241666 | 9/1996 |
| JP | 08-241670 | 9/1996 |
| JP | 08-250032 | 9/1996 |
| JP | 10-080798 | 3/1998 |
| JP | 10-220216 | 8/1998 |
| JP | 10-326579 | 12/1998 |
| KR | 1996-0002448 | 11/2002 |

OTHER PUBLICATIONS

Marton, L., "Advances in Electronics and Electron Physics," vol. III, pp. 89–185 (1956).

Mead, C.A., "Operation of Tunnel–Emission Devices," Journal of Applied Physics, vol. 32, No. 4, pp. 646–652 (1961).

(List continued on next page.)

*Primary Examiner*—Kenneth J. Ramsey
*Assistant Examiner*—Mariceli Santiago
(74) *Attorney, Agent, or Firm*—Fitzpatrick, Cella, Harper & Scinto

(57) ABSTRACT

A method of manufacturing an image forming apparatus having an envelope made of members inclusive of a first substrate and a second substrate disposed at a space being set therebetween, image forming means and spacers disposed in the envelope, the spacers maintaining the space, the method comprising the steps of forming a spacer having a desired shape by cutting a spacer base member, and abutting the spacer upon the first and second substrates at non-cut surfaces of the spacer.

5 Claims, 28 Drawing Sheets

U.S. PATENT DOCUMENTS

| | | | | | |
|---|---|---|---|---|---|
| 5,220,555 | A | | 6/1993 | Yanagisawa et al. | 369/126 |
| 5,299,184 | A | | 3/1994 | Yamano et al. | 369/44.28 |
| 5,371,727 | A | | 12/1994 | Shido et al. | 369/124 |
| 5,407,116 | A | * | 4/1995 | Nishishita et al. | 225/2 |
| 5,485,451 | A | | 1/1996 | Yamano et al. | 369/126 |
| 5,532,548 | A | | 7/1996 | Spindt et al. | 313/422 |
| 5,561,343 | A | | 10/1996 | Lowe | 313/482 |
| 5,673,476 | A | | 10/1997 | Akaike et al. | 29/825 |
| 5,675,212 | A | | 10/1997 | Schmid et al. | 313/422 |
| 5,717,287 | A | | 2/1998 | Amrine et al. | 313/495 |
| 5,721,050 | A | | 2/1998 | Roman et al. | 428/397 |
| 5,726,529 | A | | 3/1998 | Dean et al. | 313/495 |
| 5,734,224 | A | | 3/1998 | Tagawa et al. | 313/493 |
| 5,746,635 | A | * | 5/1998 | Spindt et al. | 445/24 |
| 5,760,538 | A | | 6/1998 | Mitsutake et al. | 313/422 |
| 5,785,569 | A | * | 7/1998 | Stansbury et al. | 445/25 |
| 5,811,927 | A | | 9/1998 | Anderson et al. | 313/495 |
| 5,989,090 | A | * | 11/1999 | Perrin et al. | 445/24 |
| 6,152,796 | A | | 11/2000 | Nakata | 445/24 |
| 6,308,391 | B1 | * | 10/2001 | Blaimschein et al. | 83/875 |

OTHER PUBLICATIONS

Elinson, M.I., et al., "The Emission of Hot Electrons and the Field Emission of Electrons from Tin Oxide," Radio Engineering and Electronic Physics, No. 7, pp. 1290–1295 (1995).

Hartwell, M., et al., "Strong Electron Emission From Patterned Tin–Indium Oxide Thin Films", International Electron Devices Meeting, Washington, D.C. pp. 519–521 (1975).

Myer, R., et al., "Recent Development On 'Microtips' Display Leti," Technical Digest of IVMC 91, pp. 3–6, Nagahama (1991).

Spindt, C.A., et al., "Physical Properties of Thim–Film Filed Emission Cathodes with Molybdenum Cones," Journal of Applied Physics, vol. 47, No. 12, pp. 5248–5263 (1976).

* cited by examiner

METHOD OF MANUFACTURING AN IMAGE FORMING APPARATUS HAVING IMPROVED SPACERS

This is a divisional application of application Ser. No. 09/301,583, filed Apr. 29, 1999 now U.S. Pat. No. 6,506, 087.

BACKGROUND OF THE INVENTION

1. Field of the Invention

The present invention relates to a method of manufacturing an image forming apparatus having an image forming means and a spacer in an envelope, the spacer maintaining a space in the envelope.

2. Related Background Art

Two types of electron emitting elements are known, a hot cathode element and a cold cathode element. As the cold cathode element, a surface conduction type electron emitting element (hereinafter described as a surface conduction type emitting element), a field emission type electron emitting element (hereinafter described as FE type element), a metal/insulating layer/metal type electron emitting element (hereinafter described as MIM type element) or the like are known.

The surface conduction type emitting element is described, for example, in "Radio Eng. Electron Phys." by M. I. Elinson, 10, 1290, (1965) and other examples to be later described are known.

The surface conduction type emitting element utilizes the phenomenon that electrons are emitted when current flows through a thin film having a small area formed on a substrate in parallel to the film surface. Surface conduction type emitting elements heretofore reported include an element, for example, using an $SnO_2$ thin film by Elinson or others, an element using an Au thin film ("Thin Solid Films" by G. Dittmer, 9, 317 (1972), an element using an $In_2O_3/Sno_2$ thin film ("IEEE Trans. ED Conf.", by M. Hartwell and C. G. Fonstad, 519 (1975)), an element using a carbon thin film ("Vacuum", by Hisashi ARAKI, et al., Vol. 26, No. 1, 22 (1983)), and the like.

A typical example of the structure of a surface conduction type emitting element proposed by M. Hartwell is shown in the plan view of FIG. 37. In FIG. 37, reference numeral 3001 represents a substrate, and reference numeral 3004 represents a conductive thin film made of sputtered metal oxide. The conductive thin film 3004 is of an H-character shape. The conductive thin film 2004 is subject to an electric energization process called an electric energization forming process to be described later, to thereby form an electron emission area 3005. A distance L is 0.5 to 1 mm, and a width W is 0.1 mm. In FIGS. 27A and 27B, although the electron emission area 3005 is schematically shown as a rectangle at the center of the conductive thin film 3004 for the purpose of simplicity, this does not reflect the actual shape and position of the electron emission area, with high fidelity.

The electron emission area 3005 of the element proposed by M. Hartwell or the other elements described above are generally formed by subjecting the conductive thin film 3004 to an electric energization process called an electric energization forming process to emit electrons. With the electric energization, a constant d.c. voltage or a d.c. voltage rising at a very slow rate, e.g., at 1 V/mm, is applied across opposite ends of the conductive film 3004 to locally destroy, deform or decompose the conductive thin film 3004 and form the electron emission area having an electrically high resistance. Cracks are formed in the conductive thin film 3004 where it is locally destroyed, deformed or decomposed. If a proper voltage is applied to the conductive thin film 3004 after this electric energization, electrons are emitted form an area near the cracks.

As the FE type element, those elements are known which are described, for example, in "Field emission", Advance in Electron Physics, by W. P. Dyke and W. W. Dolan, 8, 89 (1956) or in "Physical properties of thin-film field emission cathodes with molybdenum cones", J. Appl. Phys. by C. A. Spindt, 47, 5248 (1976).

A typical example of the structure of an FE type element proposed by C. A. Spindt is shown in the cross sectional view of FIG. 38. In FIG. 38, reference numeral 3010 represents a substrate, reference numeral 3011 represents an emitter layer made of conductive material, reference numeral 3012 represents an emitter cone, reference numeral 3013 represents an insulating layer, and reference numeral 3014 represents a gate electrode 3014. Electrons are emitted from the tip of the emitter cone 3012 of this element through an electric field emission by applying a proper voltage between the emitter cone 3012 and gate electrode 3014.

Instead of the lamination structure shown in FIG. 38, the FE type element having a different structure is also known in which an emitter and a gate electrode are formed on a substrate generally in parallel to the substrate surface.

As an example of the MIM type element, an element described in "Operation of tunnel-emission Devices", by C. A Mead, J. Appl. Phys., 32, 646 (1961) and other elements are known. A typical example of the structure of an MIM type element is shown in the cross sectional view of FIG. 39. In FIG. 39, reference numeral 3020 represents a substrate, reference numeral 3021 represents a lower electrode made of metal, reference numeral 3022 represents a thin insulating layer of about 100 angstroms in thickness, and reference numeral 3023 represents an upper electrode made of metal and having a thickness of about 80 to 300 angstroms. Electrons are emitted from the surface of the upper electrode 3023 of the MIM type element by applying a proper voltage between the upper electrode 3023 and lower electrode 3021.

The cold cathode elements described above can emit electrons at a temperature lower than hot cathode elements, and do not require a heater. Therefore, the structure is simpler than that of a hot cathode element and a fine element can be manufactured. Also, even if a number of elements are formed on a substrate at a high density, thermal melting of a substrate is not likely to occur. Although a response speed of a hot cathode element is low because of heating the heater, a response speed of a cold cathode element is high.

From the above reasons, applications of cold cathode elements have been studied vigorously.

For example, since a surface conduction type emitting element among cold cathode elements is simple in structure and easy to manufacture, it has the advantage that a number of elements can be formed in a large area. As disclosed in JP-A-64-31332 by the same assignee as the present assignee, a method of driving a number of elements has been studied. As the applications of surface conduction type emitting elements, an image forming apparatus for an image display device, an image recording device, a charge beam source, and the like have been studied.

As the application to an image display apparatus, an image display apparatus utilizing a combination of surface conduction type emitting elements and a fluorescent member which emits light upon application of an electron beam, has been studied as disclosed in U.S. Pat. No. 5,066,883, JP-A-

2-257551, JP-A-4-28137 by the same assignee as the present assignee. An image display apparatus utilizing a combination of surface conduction type emitting elements and a fluorescent member is expected to have more excellent characteristics than a conventional image display apparatus of other types. For example, as compared to a recently prevailing liquid crystal display apparatus, the image display apparatus of this type does not require back light because of self light emission and has a broad angle of view.

A method of driving a number of FE type elements is disclosed in U.S. Pat. No. 4,904,895 by the same assignee as the present assignee. An example of the application of FE type elements to an image display apparatus is a flat panel type display apparatus reported by R. Meyer in "Recent Development on Microtips Display st LETI", Tech. Digest of 4th int. Vacuum Microelectronics Conf., Nagahama, pp. 6–9 (1991).

An example of the application of a number of MIM type elements to an image-display apparatus is disclosed in JP-A-3-55738 by the same assignee as the present assignee.

Of image forming apparatuses utilizing the above-described electron emitting elements, a flat panel type display apparatus having a thin depth requires less space and is light in weight. Therefore, the flat panel type display apparatus has drawn attention as a substitute for a CRT type display apparatus.

FIG. 40 is a perspective view showing an example of a display panel portion of a flat panel type image display apparatus. A portion of the panel is broken in order to shown the internal structure.

In FIG. 40, reference numeral 3115 represents a rear plate, reference numeral 3116 represents a side wall, and reference numeral 3117 represents a face plate. The rear plate 3115, side wall 3116 and face plate 3117 constitute an envelope (air-tight envelope) which maintains the inside of the display panel vacuum.

A substrate 3111 is fixed to the rear plate 3115. N×M cold cathode elements 3112 are formed on the substrate. N and M are positive integers of 2 or larger and are properly set in accordance with a target number of display pixels. The N×M cold cathode elements 3112 are wired as shown in FIG. 40 by M row direction wiring lines 3113 and N column direction wiring lines 3114. A structure made of the substrate 3111, cold cathode elements 3112, row direction wiring lines 3113, and column direction wiring lines 3114 is called a multi electron beam source. At each cross area of the row direction wiring line 3113 and column direction wiring line 3114, an insulating layer (not shown) is formed between the lines to provide electrical insulation.

A fluorescent film 3118 made of fluorescent material is formed on the bottom surface of the face place 3117. The fluorescent materials of red (R), green (G) and blue (B) colors of three primary colors are divisionally coated to form the fluorescent film 3118. Black color material (not shown) is coated between the color fluorescent materials of the fluorescent film 3118. A metal back 3119 made of Al or the like is formed on the fluorescent film 3110 on the side of the rear plate 3115.

Dx1 to Dxm, Dy1 to Dyn, and Hv are electrical connection terminals of an air-tight structure for electrically connecting the display panel to an unrepresented electric circuit. Dx1 to Dxm are electrically connected to the row direction wiring lines 3113 of the multi electron beam source, Dy1 to Dyn are electrically connected to the column direction wiring lines 3114 of the multi electron beam source, and Hv is electrically connected to the metal back 3119.

The inside of the air-tight envelope is maintained at a vacuum of about $10^{-6}$ Torr. As the display area of the image display apparatus becomes large, a pressure difference between the inside of the air-tight envelope and the outside thereof becomes large. It is therefore necessary to provide means for preventing the rear plate 3115 and face plate 3117 from being deformed or destroyed. If the rear plate 3115 and face plate 3117 are made thick, not only the weight of the image display apparatus increases, but also an image distortion increases when viewed obliquely and a parallax may occur. In the example shown in FIG. 40, structural support members (called a spacer or rib) 3120 made of relatively thin glass plates are mounted in order to be resistant to the atmospheric pressure. The distance between the substrate 3111 with the multi electron beam source and the face plate 3117 with the fluorescent film 3118 is maintained usually sub-mm or several mm, and the inside of the air-tight envelope is maintained highly vacuum as described earlier.

As a voltage is applied to each cold cathode element 3112 via the terminals Ds1 to Dxm and Dy1 to Dyn of the image display apparatus using the above-described display panel, electrons are emitted from each cold cathode element 3112. At the same time, a high voltage of several hundreds V to several kV is applied via the terminal Hv to the metal back 3119 to accelerate the-emitted electrons and make them collide with the inner surface of the face plate 3117. The fluorescent materials of each color constituting the fluorescent film 3118 emit light and an image can be displayed.

A spacer having a space maintaining function sufficient for maintaining the space in the air-tight envelope of the image display apparatus described above has been desired, and also a method of efficiently forming the spacer has been desired.

SUMMARY OF THE INVENTION

It is an object of the present invention to provide a method of manufacturing an image forming apparatus provided with spacers having an improved space maintaining function.

It is another object of the invention to provide a method of manufacturing an image forming apparatus using electron emitting elements capable of further reducing a displacement of an electron trajectory to be caused by a spacer.

It is a further object of the invention to provide a method of manufacturing an image forming apparatus capable of forming spacers with improved work efficiency and manufacture yield.

It is another object of the invention to provide an image forming apparatus capable of displaying a high quality image.

In order to achieve the above objects of the invention, a method of manufacturing-an image forming apparatus having an envelope made of members inclusive of a first substrate and a second substrate disposed at a space being set therebetween, image forming means and spacers disposed in the envelope, the spacers maintaining the space, is provided. The method comprises the steps of: forming a spacer having a desired shape by cutting a spacer base member; and abutting the spacer upon the first substrate or second substrate at non-cut surface of the spacer.

DETAILED DESCRIPTION OF THE PREFERRED EMBODIMENTS

Figure 1:
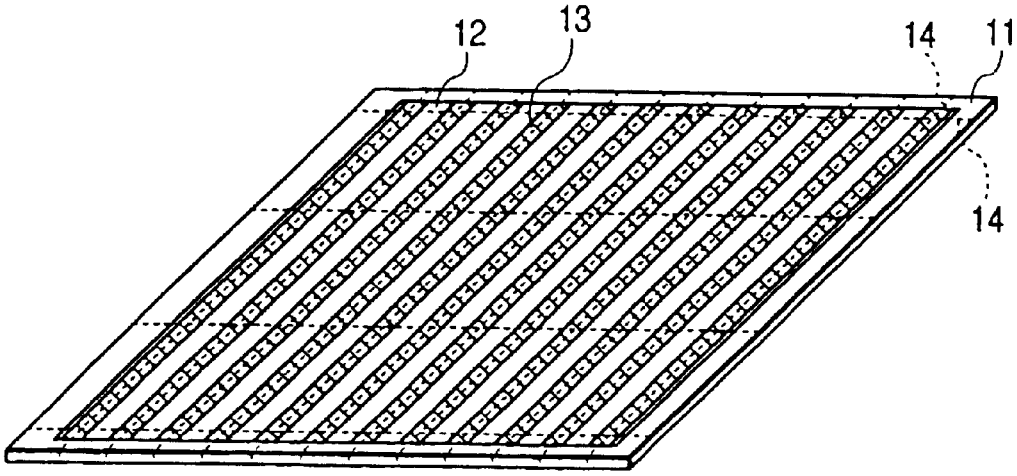
FIG. 1 is a perspective view showing an example of a spacer base member used for forming spacers.

The invention provides a method of manufacturing an image forming apparatus having an envelope made of members inclusive of a first substrate and a second substrate disposed at a space being set therebetween, and image forming means disposed in the envelope, the method comprising the steps of: forming spacers to be disposed in the envelope to maintain the space and disposing the spacers in the envelope. The spacer of this invention may be either an insulating spacer or a conductive spacer.

The image forming apparatus of this invention may include, for example, a liquid crystal display panel, a plasma display panel, or an electron beam display panel. These image forming apparatus each have in its envelope the image forming means and the spacers for maintaining the space in the envelope.

For example, the image forming means of an electron beam display panel may include electron emitting elements and an image forming member for forming image when electrons are applied from the electron emitting elements. The image forming member may include an acceleration electrode for accelerating electrons and a fluorescent member which emits light when electrons are applied.

The envelope of an electron beam display panel may be made of first and second substrates disposed at the space being set therebetween, the first substrate being formed with electron emitting elements and the second substrate being formed with the image forming member.

According to a first aspect of a method of manufacturing an image forming apparatus of this invention, first a spacer base member larger than each spacer to be disposed in the envelope is cut to form a spacer having a desired shape, and then these spacers are disposed in the envelope in such a manner that the cut surface of the base spacer member is not abutted upon the first or second substrate but the non-cut surface of the spacer is abutted upon the first or second substrate. The cut surface of the spacer base member is likely to form cracks and broken pieces. Therefore, it is effective from the viewpoint of the space maintaining function that the non-cut surface is used as an abut surface rather than that the cut surface is used as an abut surface. It is preferable from the viewpoint of work efficiency that a plurality of spacers having a desired shape be formed from one spacer base member.

According to a second aspect of the method of manufacturing an image forming apparatus of this invention, first, similar to the first aspect, a spacer base member larger than each spacer to be disposed in the envelope is cut to form a spacer having a desired shape. In this case, in the second aspect, a groove is formed in advance at the cut position of the spacer base member, and the spacer base member is cut along this groove to form the spacer having the desired shape. This groove may be formed intermittently or continuously along the cut position. It is however preferable as will be later described that the groove is formed continuously in order to reduce cracks and broken pieces on the cut surface as many as possible. Next, in the second aspect, the spacer is disposed in the envelope in such a manner that the cut surface of the spacer base member is abutted on the first or second substrate. Since the groove is formed in advance in the spacer base member and this member is cut along the groove, cracks and broken pieces at the cut surface can be reduced as many as possible. It is therefore more effective from the viewpoint of the space maintaining function that the cut surface with the groove is used as an abut surface rather than that the cut surface without the groove is used as an abut surface. Also in this aspect, it is preferable from the viewpoint of work efficiency that a plurality of spacers having a desired shape be formed from one spacer base member. Further in this aspect, it is more effective, from the viewpoint of that cracks and broken pieces at the cut surface can be reduced as many as possible, that the groove is formed on both surfaces of the spacer base member along the cut position if the spacer base member is of a plate shape.

The spacer to be disposed in the envelope of the image forming apparatus of this invention may be formed with a conductive film on the surface thereof as will be described in the following.

Figure 36A:
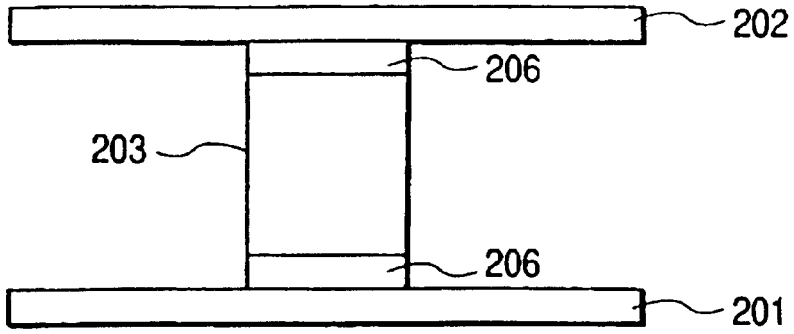
FIGS. 36A, 36B and 36C are diagrams illustrating a conductive film formed on the spacer surface.

As shown in FIG. 36A, a conductive film 206 is formed on opposite end portions of a spacer 203 near at the abut portions of the spacer 203 upon first and second substrates 201 and 202 constituting the envelope. The conductive film 206 may be formed on the end portion of the spacer 203 on the side of either the first substrate 201 or second substrate 202.

The conductive film 206 defines the potential at the end portion of the spacer 203 and is applied with a predetermined potential. For example, the conductive film 206 on the side of the first substrate 201 is electrically connected to a wiring electrode of the electron emitting elements on the first substrate, whereas the conductive film 206 on the side of the second substrate 202 is electronically connected to the acceleration electrode on the second substrate 202. The conductive films disposed on the opposite end portions of the spacer can therefore stabilize the trajectory of electrons emitted from the electron emitting element.

Figure 36B:
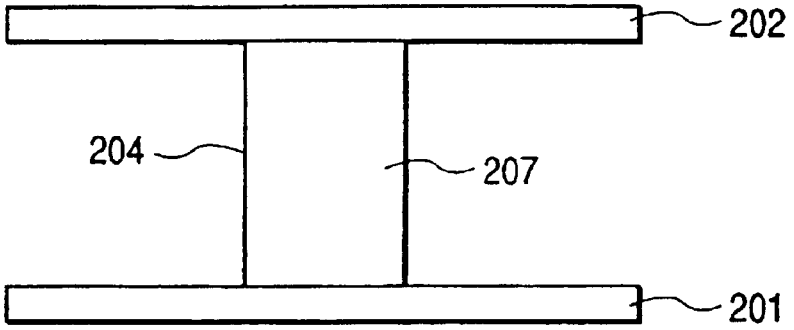

As shown in FIG. 36B, a conductive film 207 is formed on the surface of a spacer 204. This conductive film 207 is preferably a relatively high resistance film as will be described later.

This conductive film 207 is electrically connected to a conductor on a first substrate 201 and to a conductor on a second substrate 202. For example, the conductive film 207 on the side of the first substrate 201 is electrically connected to the electron emitting elements on the first substrate 201, whereas the conductive film 207 on the side of the second substrate 202 is electrically connected to the acceleration electrode on the second substrate 202. The conductive film 207 therefore allows the surface of the spacer 204 to flow a small current to thereby remove charges accumulated on the spacer surface.

Figure 36C:
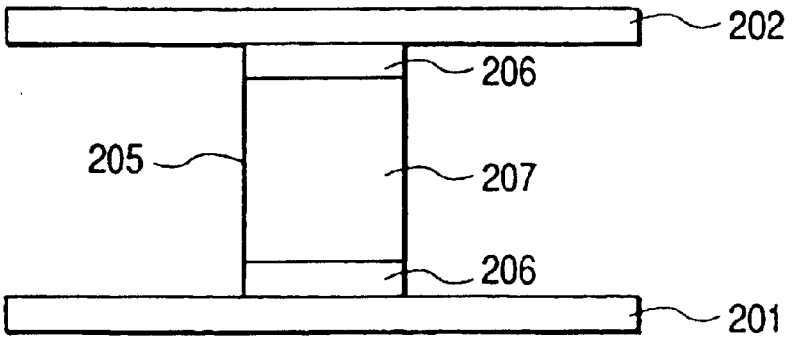
Figure 37:
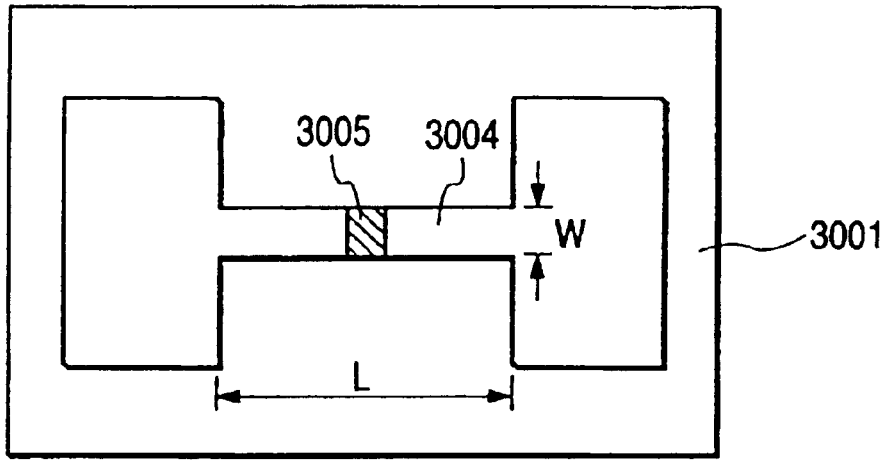
FIG. 37 is a diagram showing an example of a conventional surface conduction type emitting element.
Figure 38:
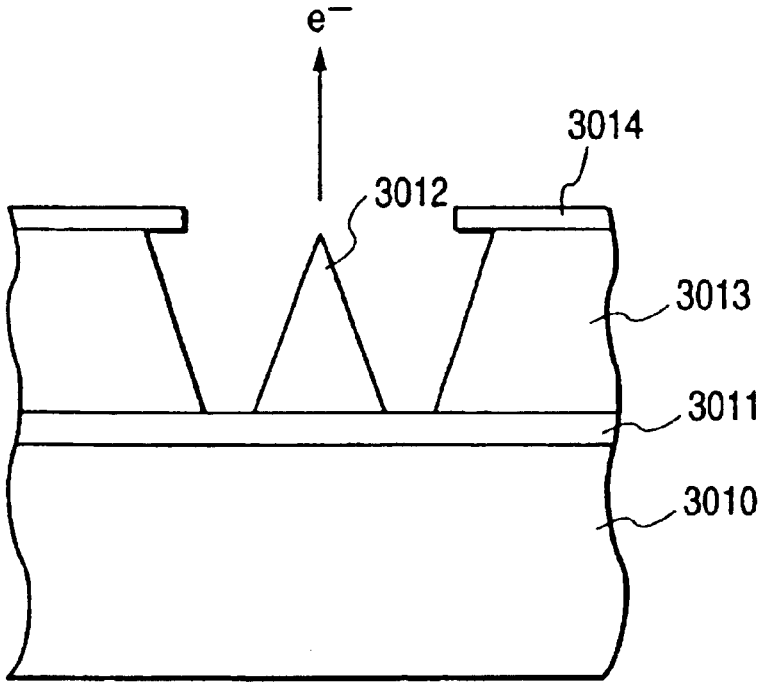
FIG. 38 is a diagram showing an example of a conventional FE type element.
Figure 39:
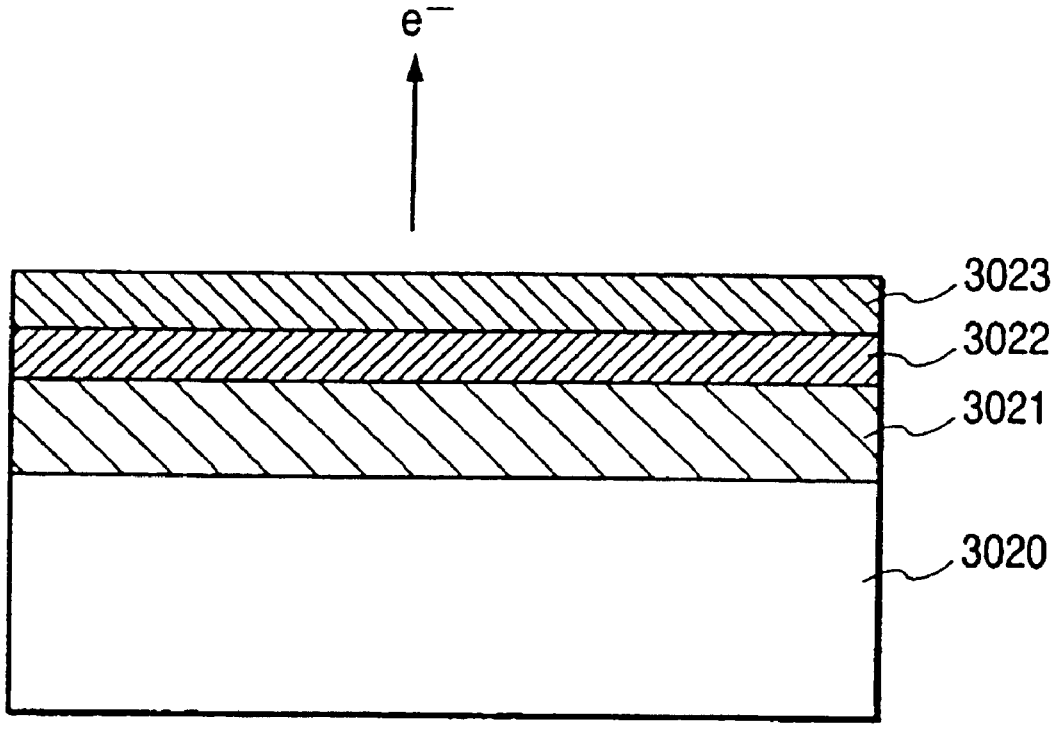
FIG. 39 is a diagram showing an example of a conventional MIM type element.
Figure 40:
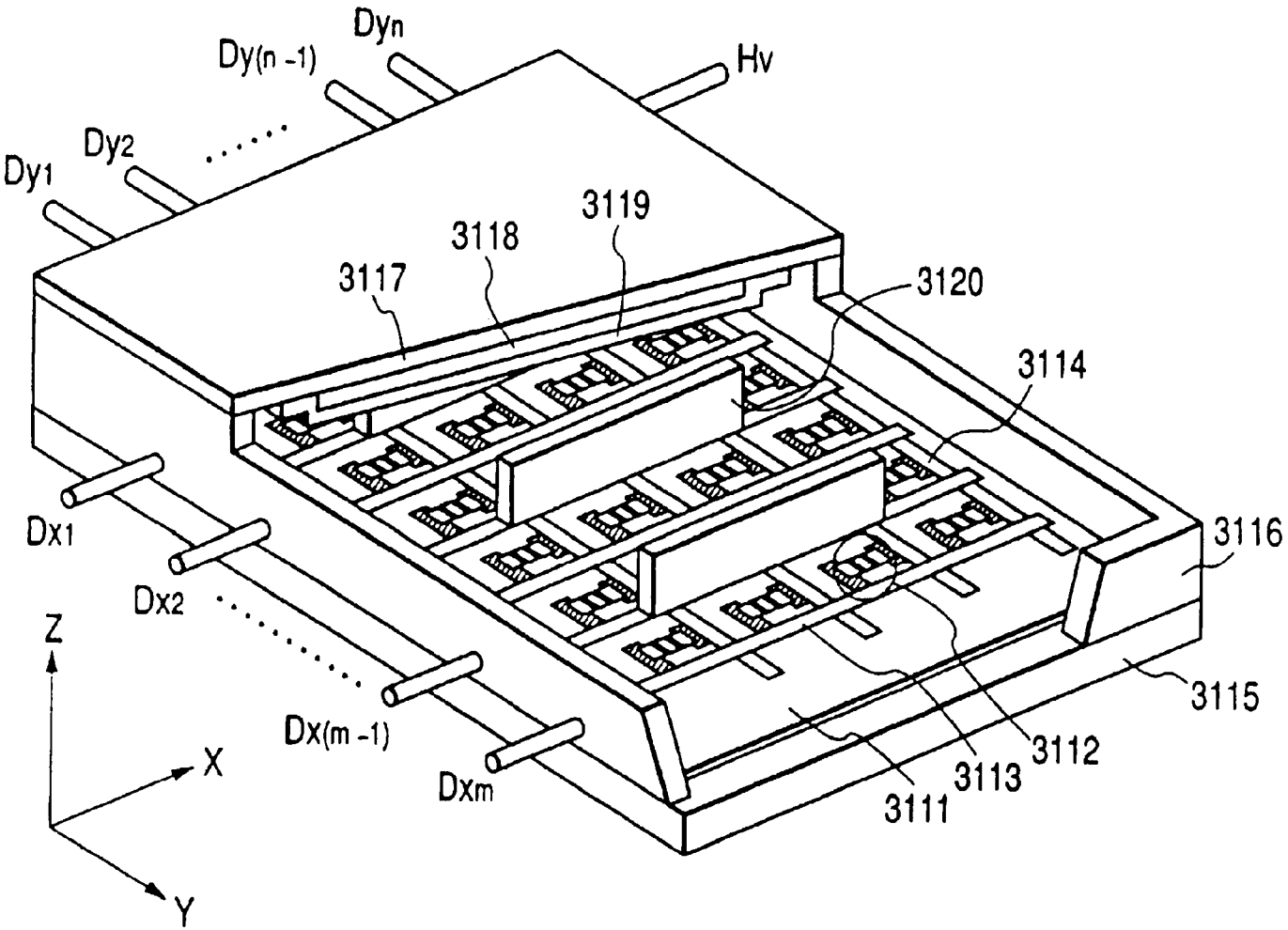
FIG. 40 is a perspective view of a display panel of an image display apparatus, with a portion thereof being broken.

As shown in FIG. 36C, a conductive film 207 is formed on the surface of a spacer 205 and another conductive film 206 is formed on the opposite end portions of the spacer 205. The conductive film 206 has the function similar to that of the conductive film shown in FIG. 36A, and the conductive film 207 has the function similar to that of the conductive film shown in FIG. 36B and has a resistance higher than that of the conductive film 206.

The spacer shown in FIG. 36C has the advantages that charges accumulated on the spacer surface are removed and that the trajectory of electrons emitted from the electron emitting element can be stabilized.

The following methods of the invention are used when a spacer with a conductive film formed thereon is disposed in the envelope.

According to a third aspect of the method of manufacturing an image forming apparatus of this invention, first, a conductive film is formed on the surfaces of a spacer base member larger than each spacer to be disposed in the envelope. Thereafter, the spacer base member with the conductive film is cut to form a spacer having a desired shape. The work efficiency can therefore be improved more than the case wherein the conductive film is formed after the spacer base member is cut. Next, the spacer is disposed in the envelope in such a manner that the cut surface of the spacer base member is not abutted on the first or second substrate but the non-cut surface of the spacer is abutted on the first or second substrate. As described earlier, this is because of an effectiveness from the viewpoint of the space maintaining function. Furthermore, since the conductive film is likely to be peeled off from the spacer base member, the electrical connection of the conductive film can be improved if the non-cut surface of the spacer is abutted on the first or second substrate rather than the cut surface of the spacer base member is abutted on the first or second substrate. It is more preferable from the viewpoint of work efficiency that a plurality of spacers having a desired shape be formed from one spacer base member.

According to a fourth aspect of the method of manufacturing an image forming apparatus of this invention, first, similar to the second aspect, a groove is formed in advance at the cut position of a spacer base member larger than each spacer to be disposed in the envelope. In this aspect, the conductive film is formed at least on this groove. Thereafter, the spacer base member is cut along the groove to form a spacer having a desired shape. This groove may be formed intermittently or continuously along the cut position. It is however preferable as will be later described that the groove is formed continuously in order to reduce cracks and broken pieces on the cut surface as many as possible and suppress peel-off of the conductive film as much as possible. It is more preferable from the viewpoint of work efficiency that a plurality of spacers having a desired shape be formed from one spacer base member. Next, the spacer is disposed in the envelope in such a manner that the cut surface of the spacer base member is abutted on the first or second substrate. The groove is formed in advance in the spacer base member and the conductive film is formed at least on this groove, and thereafter, the spacer base member is cut along the groove. Therefore, cracks and broken pieces at the cut surface can be reduced as many as possible and peel-off of the conductive film can be suppressed as much as possible. It is therefore more effective from the viewpoint of the space maintaining function and the electrical connection of the conductive film that the cut surface with the groove is used as an abut surface rather than that the cut surface without the groove is used as an abut surface. Also in this aspect, it is preferable from the viewpoint of work efficiency that a plurality of spacers having a desired shape be formed from one spacer base member. Further in this aspect, it is more effective, from the viewpoint of that cracks and broken pieces at the cut surface can be reduced as many as possible and that peel-off of the conductive film can be suppressed as much as possible, that the groove is formed on both surfaces of the spacer base member along the cut position if the spacer base member is of a plate shape.

Also in this aspect, the groove is preferably formed to have a tapered shape. If the groove has the tapered shape, the contact area between the conductive film and the conductor on the substrate becomes large by a pressure imparted when the space is abutted upon the substrate. Therefore, the electrical connection can be improved. This tapered shape is particularly effective if an abut member itself of the spacer is made of flexible material at least at a producing step or if the spacer is abutted via flexible conductive member such as conductive adhesive at least at the producing step.

Of the first to fourth aspects described above, particularly the first and third aspects of the invention are preferable from the viewpoint of the space maintaining function, electrical connection and work efficiency, because the cut surface of the spacer is not abutted upon the substrate but the non-cut surface of the spacer is abutted upon the substrate.

The image forming apparatus and its manufacture method will be described more specifically in the following with reference to preferred embodiments.

Figure 19:
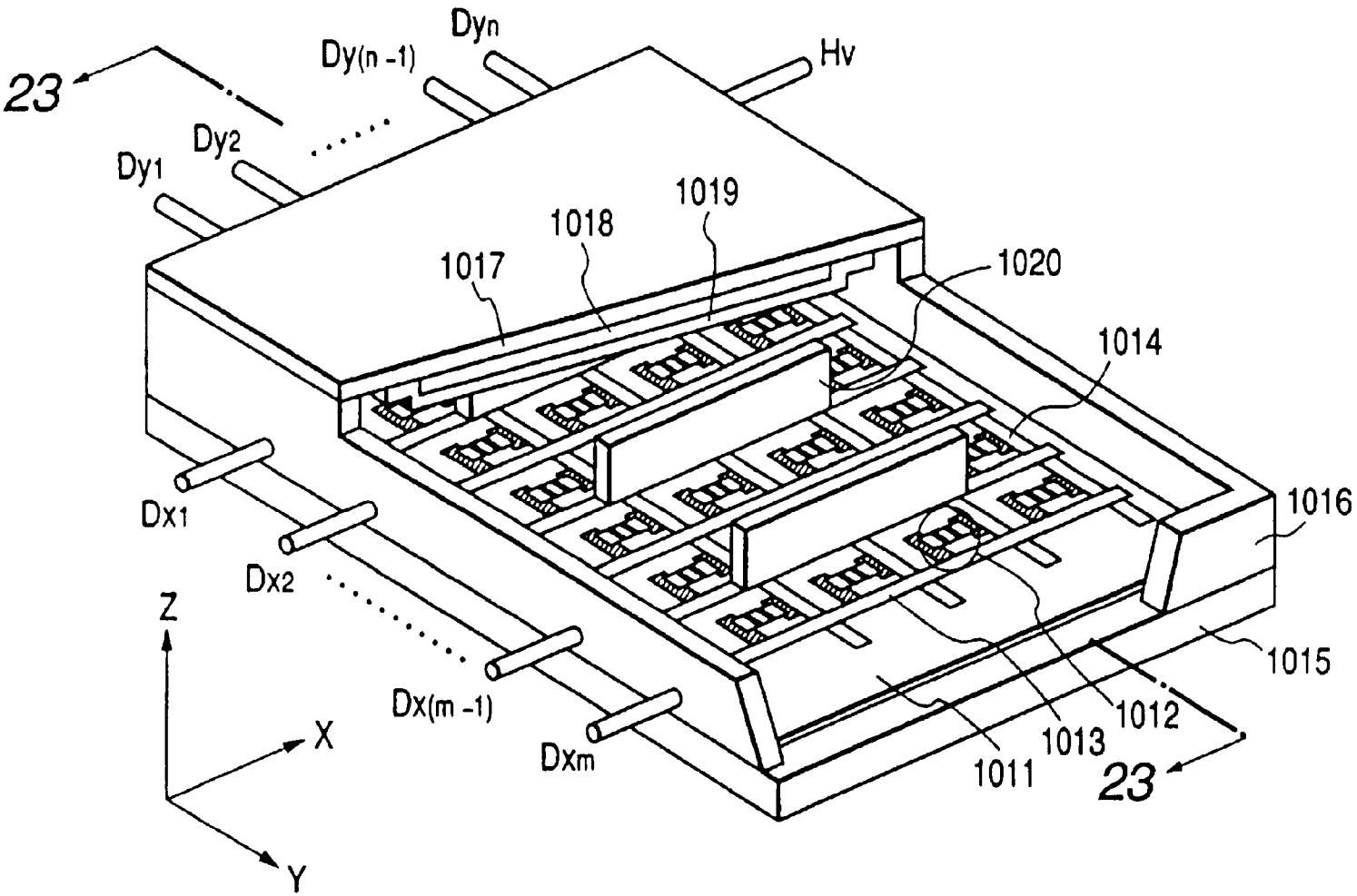
FIG. 19 is a perspective view of an image forming apparatus according to an embodiment of the invention with a portion of a display panel removed.

FIG. 19 is a perspective view of a display panel of an image forming apparatus according to an embodiment of the invention with a portion of the panel removed in order to show the internal structure thereof.

In FIG. 19, reference numeral 1015 represents a rear plate, reference numeral 1016 represents a side wall, and reference numeral 1017 represents a face plate. The rear plate 1015, side wall 1016 and face plate 1017 constitute an air-tight envelope which maintains the inside of the display panel vacuum. In assembling the display panel, a connection area between respective components is required to be hermetically adhered in order to provide the connection area with sufficient strength and air-tightness. Such hermetical adhesion was achieved by coating the connection area with, for example, frit glass, and baking the glass in the atmospheric air or in a nitrogen atmosphere for 10 minutes or longer at 400 to 500° C. A method of evacuating the inside of the air-tight envelope will be later described. The inside of the air-tight envelope is maintained at a vacuum of about $10^{-6}$ Torr. In order to prevent the air-tight envelope from being destroyed by the atmospheric pressed or unexpected impacts, spacers 1020 are used as an atmospheric pressure resistant structure.

A substrate 1011 is fixed to the rear plate 1015. N×M cold cathode elements 1012 are formed on the substrate. N and M are positive integers of 2 or larger and are properly set in accordance with a target number of display pixels. If the display apparatus is used for a high definition TV, it is preferable to set N=300 and M=1000. The N×M cold cathode elements 1012 are wired in a simple matrix form by M row direction wiring lines 1013 and N column direction wiring lines 1014. A structure made of the substrate 1011, cold cathode elements 1012, row direction wiring lines 1013, and column direction wiring lines 1014 is called a multi electron beam source.

The material and shape of a cold cathode element of the multi-electron beam source used by the image display apparatus, and its manufacture method, are not limited so long as an electron beam source has cold cathode elements wired in a simple matrix form. Therefore, cold cathode elements such as surface conduction type emitting elements, FE type elements, and MIM type elements may be used.

Next, the structure of the multi electron beam source having surface conduction type elements (to be later described) as cold cathode elements wired in a simple matrix form will be described.

Figure 20:
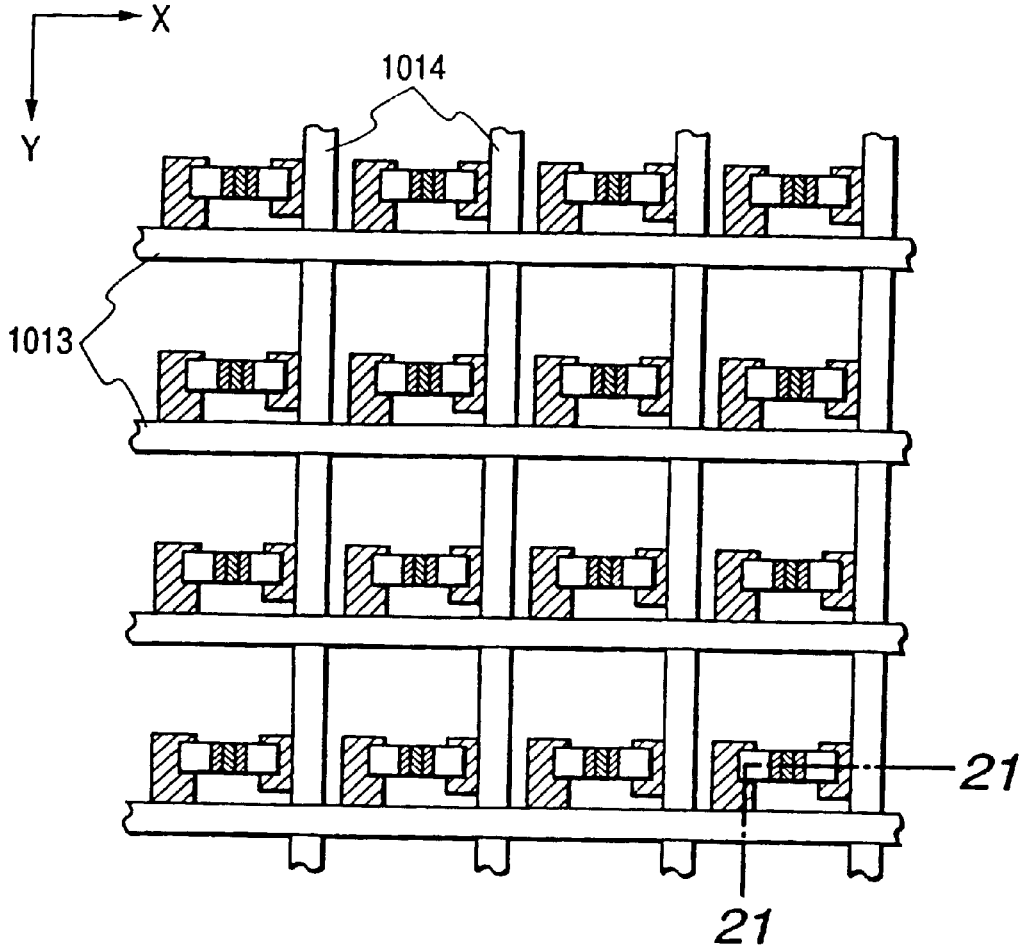
FIG. 20 is a plan view showing a substrate of a multi-electron beam source used by the embodiment illustrated in FIG. 19.

FIG. 20 is a plan view of a multi-electron beam source used by the display panel shown in FIG. 19. On a substrate 1011, surface conduction type emitting elements similar to those shown in FIGS. 24A and 24B described in detail below are disposed and wired in a simple matrix form by row direction wiring electrodes 1003 and column direction wiring electrodes 1004. At each cross area of the row direction wiring electrode 1003 and column direction wiring electrode 1004, an insulating layer (not shown) is formed between the electrodes to provide electrical insulation.

Figure 21:
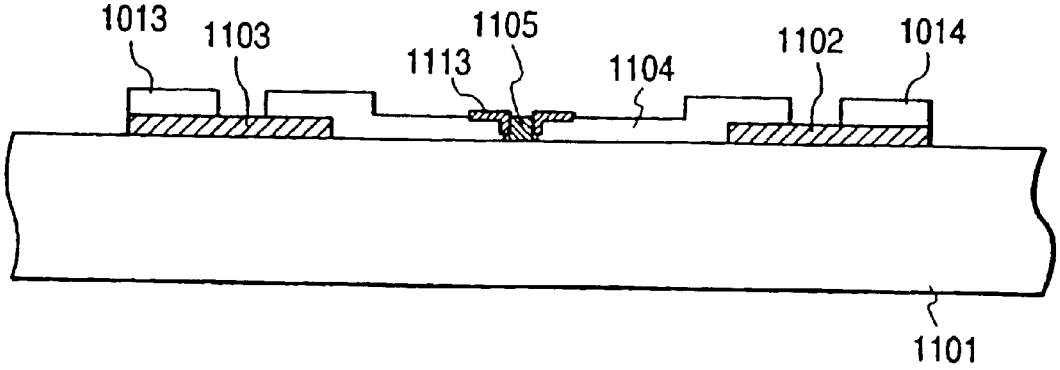
FIG. 21 is a cross sectional view showing a portion of the substrate of the multi-electron beam source used by the embodiment illustrated in FIG. 19.

FIG. 21 is a cross sectional view taken along line 21—21 of FIG. 20.

The multi-electron beam source having the above-described structure is manufactured by forming the row direction wiring electrodes 1003, column direction wiring electrodes 1004, electrode insulating layer (not shown), element electrodes and a conductive thin film of each surface conduction type emitting element, and thereafter supplying a power to each element via the row and column direction wiring electrodes 1003 and 1004 to perform an electric energization forming process described in detail below and an electric energization activation process also described in detail below.

In this embodiment, although the substrate 1011 of the multi-electron beam source is fixed to the rear plate 1015 of the air-tight envelope, if the substrate 1011 of the multi-electron beam source has a sufficient strength, the substrate 1011 itself of the multi-electron beam source may be used directly as the rear plate of the air-tight envelope.

Figure 22A:
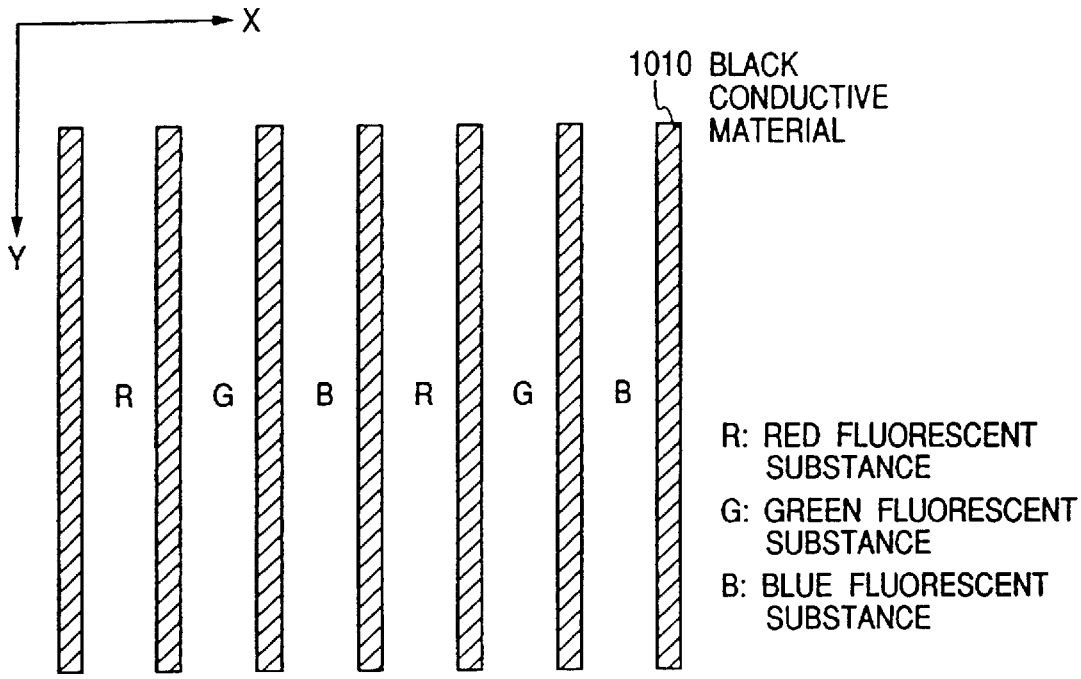
FIGS. 22A and 22B are plan views showing examples of a layout of flourescent materials of a face plate of the display panel of the embodiment shown in FIG. 19.

A fluorescent film 1018 made of fluorescent material is formed on the bottom surface of the face place 1017. Since the apparatus of the embodiment is a color display apparatus, the fluorescent materials of red (R), green (G) and blue (B) colors of three primary colors are divisionally coated to form the fluorescent film 1018. The fluorescent material of each color is coated, for example, in stripe shapes such as shown in FIG. 22A, and black color conductive material 1010 is coated between fluorescent material stripes. An object of the black color conductive material 1010 is to prevent a display color shift even if there is some displacement of a radiation position of an electron beam, to prevent external light reflection to thereby avoid a lower display contrast, to prevent charge-up of the fluorescent film to be caused by electron beams, and for other purposes. Although the black color conductive material 1010 has black lead as its main composition, other materials may also be used if the above-described objects can be achieved.

Figure 22B:
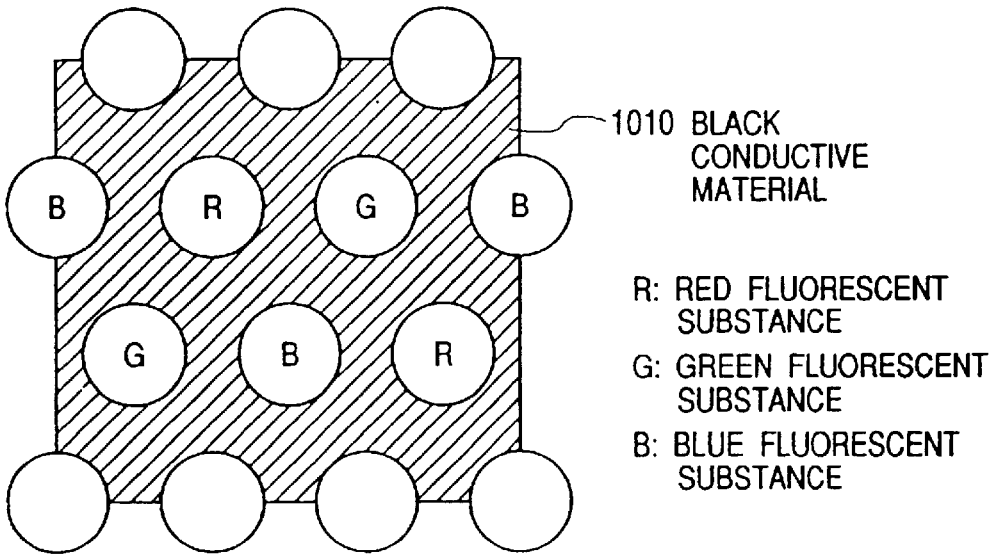

The coating of fluorescent materials of three primary colors is not limited only to the stripe layout shown in FIG. 22A. For example, a delta layout shown in FIG. 22B and other layouts may also be used.

If a monochrome display panel is to be formed, the black color conductive material is not necessarily used.

A metal back 1019 well known in the CRT technical field is formed on the fluorescent film 1018 on the side of the rear plate. An object of the metal back 1019 is to improve a light use efficiency by mirror-reflecting a portion of light emitted from the fluorescent film 1018, to protect the fluorescent film 1018 from negative ion impacts, to use it as an electrode for applying an electron beam acceleration voltage, to use it as a conductive path of electrons which excited the fluorescent film 1018, and for other purposes. The metal back 1019 was formed by forming the fluorescent film 1018 on the face plate substrate 1017, thereafter planarizing the surface of the fluorescent film 1018, and vacuum depositing Al on the surface of the fluorescent film 1018. If the fluorescent film 1018 is made of low voltage fluorescent materials, the metal back 1019 may not be used.

Although not used in this embodiment, a transparent electrode made of, for example, ITO, may be formed between the face plate substrate 1017 and fluorescent film 1018 in order to apply an acceleration voltage or improve the conductivity of the fluorescent film.

Figure 23:
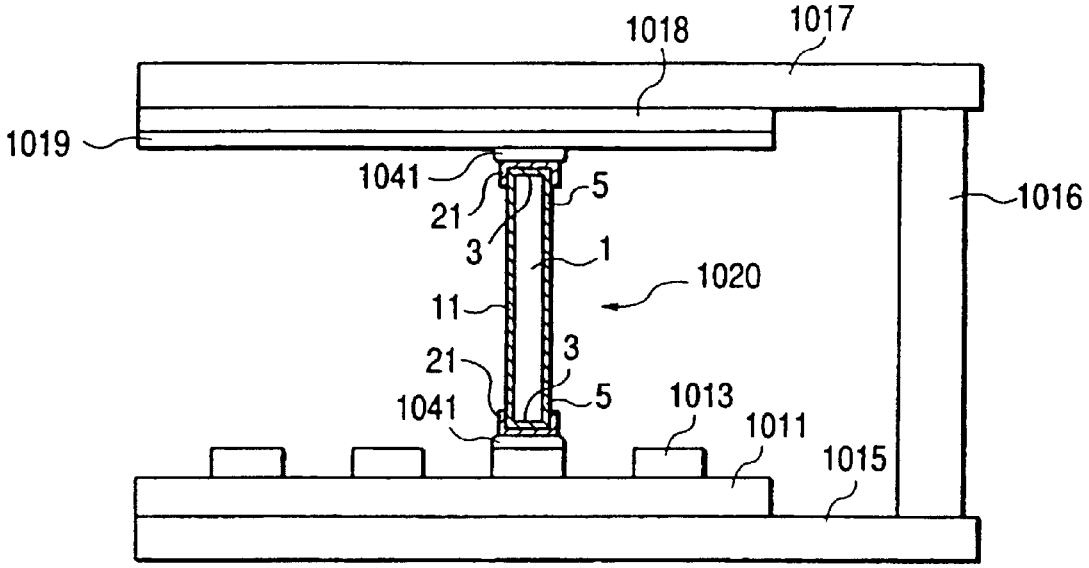
FIG. 23 is a cross sectional view of the display panel taken along line 23—23 in FIG. 19.

FIG. 23 is a schematic cross sectional view taken along line 23—23 of FIG. 19. In FIG. 23, reference numerals correspond to those used in FIG. 19. A spacer 1020 is a spacer formed by the method of the third embodiment to be described later. The spacer 1020 is made of an insulating member 1, a first conductive film (hereinafter called a high resistance film) 11 and a second conductive film (hereinafter called a low resistance film or an intermediate layer) 21. The high resistance film 11 is formed on the surface of the insulating member 1 in order to prevent charge accumulation. The low resistance film 21 has a resistance lower than the high resistance film 11. The row resistance film 21 is formed on abut surfaces 3 on the inner side (such as metal back 1019) of the face plate 1017 and the surface (such as row or column direction wiring lead 1013 or 1014) of a substrate 1011 and on the upper and lower side surface 5 of the high resistance film 11. Spacers are disposed as many as necessary for achieving the objects of spacer at a necessary pitch. Each spacer is fixed by adhesion members 1041 between the inside of the face plate and the surface of the substrate 1011. The high resistance film 11 is electrically connected to the inner side (such as metal back 1019) of the face plate 1017 and the surface (such as row or column direction wiring lead 1013 or 1014) of the substrate 1011 via the low resistance film 21 and connection member 1041. In this embodiment, the spacer 1020 is of a thin plate shape, and is disposed in parallel to the row direction wiring line 1013 and electrically connected to the wiring line 1013.

The spacer 1020 is required to provide an insulation resistant to a high voltage applied between the row and column direction wiring leads 1013 and 1014 on the substrate 1011 and the metal back 1019 on the bottom surface of the face plate 1017, and also to provide a conductivity capable of preventing charge accumulation on the surface of the spacer 1020.

The insulating member 1 of the spacer 1020 may be made of quartz glass, glass having a reduced amount of impurities such as Na, soda-lime glass, ceramic such as alumina. The insulating member 1 preferably has a thermal expansion coefficient nearly equal to that of the air-tight envelope and substrate 1011.

Current flows in the high resistance film 11 of the spacer 1020, the current having a value of an acceleration voltage Va applied to the high potential side face plate 1017 (such as metal back 1019) divided by the resistance value Rs of the high resistance film 21 serving as a charge prevention film. The resistance value Rs of the spacer is therefore set to a proper value from the standpoint of charge prevention and consumption power. From the standpoint of charge prevention, the surface resistance R/□ is preferably set to $10^{12}\Omega$ or smaller. In order to achieve the sufficient charge prevention effect, the surface resistance of $10^{11}\Omega$ or smaller is more preferable. Although the lower limit of the surface resistance is dependent upon the spacer shape and a voltage applied across the spacer, it is preferably set to $10^{5}\Omega$ or larger.

The thickness t of the charge prevention film formed on the insulating member 1 is preferably set in a range from 10 nm to 1 $\mu$m. A thin film of 10 nm or thinner is generally formed in an island shape and the resistance thereof is unstable and the reproductivity thereof is poor, although they depend on a surface energy of the material, tight contactness to the substrate, and a substrate temperature. If the film thickness is 1 $\mu$m or thicker, a film stress becomes large, a possibility of film peel-off becomes high, and the film forming time becomes long which results in poor productivity. It is therefore preferable to set the film thickness to 50 to 500 nm. The surface resistance R/□ is $\rho/t$. From the preferable range of R/□ and t described above, the specific resistance $\rho$ is preferably set to 0.1 Ωcm to $10^{8}$ Ωcm. In order to realize a more preferable range of the surface resistance and film thickness, the specific resistance $\rho$ is more preferably set to $10^{2}$ Ωcm to $10^{6}$ Ωcm.

The temperature of the spacer rises while current flows in the charge prevention film or while the display apparatus generates heat during its operation. If the resistance temperature coefficient of the charge prevention film is negative, the resistance value lowers as the temperature rises so that the current flowing in the spacer increases to further raise the temperature. The current increases until it exceeds the limit value. The resistance temperature coefficient allowing such current runaway has empirically a negative value whose absolute value is 1% or higher. It is therefore desired that the resistance temperature coefficient of the charge prevention film is smaller than −1%.

The material of the high resistance film 11 having the charge prevention performance may be metal oxide. Of the metal oxide, oxide of chrome, nickel or copper is preferable. The reason for this is that these oxides have a relatively small secondary electron emission efficiency and even if electrons emitted from the cold cathode element 1012 collide with the spacer 1020, the spacer is hard to be charged. In addition to the metal oxide, carbon is a preferable material because of its small secondary electron emission efficiency. Amorphous carbon in particular has a high resistance value so that the resistance of the spacer is easy to be controlled to be set to a desired value.

Other preferable materials of the high resistance film 11 having the charge prevention performance are nitride of aluminum and transition metal because a broad range of the resistance value from good conductor to insulator can be controlled by adjusting the component of transition metal. Other materials to be later described with reference to a process of manufacturing a display apparatus are also preferable because these materials have a small resistance change and are stable and also the resistance temperature coefficient is less than −1% and the materials can be used-easily in practice. Such transition material may be Ti, Cr, Ta or the like.

A nitride film is deposited on the insulating member by thin film forming methods such as sputtering, reactive sputtering in a nitrogen atmosphere, electron beam vapor deposition, ion plating, and ion assist vapor deposition. A metal oxide film may be formed by similar thin film forming methods. In this case, oxygen gas is used in place of nitrogen gas. The metal oxide film may be formed by CVD or alkoxide coating. A carbon film may be formed by vapor deposition, sputtering, CVD, or plasma CVD. If amorphous carbon is formed, an atmosphere containing hydrogen is used and hydrocarbon gas is used as a source gas.

The low resistance films 21 of the spacer 1020 are provided in order to electrically connect the high resistance film 11 to the high potential side face plate (such as metal back 1019) and to the low potential side substrate 1011 (such as wiring lead 1013, 1014). The low resistance film 21 is also called an intermediate electrode layer (intermediate layer) where applicable in the following description. The intermediate electrode layer (intermediate layer) provides a plurality of functions described in the following.

(1) The intermediate films electrically connect the high resistance film 11 to the face plate 1017 and substrate 1011.

As already described, the high resistance film is provided in order to prevent the surface of the spacer 1020 from being charged. If the high resistance film 11 is connected directly or via the connection members 1041 to the face plate (such as metal back 1019) and substrate 1011 (such as wiring lead 1013, 1014), a connection interface has a large contact resistance and charges accumulated on the spacer surface may become difficult to be removed quickly. In order to avoid this, the abut surface 3 and side surfaces 5 of the spacer 1020 in contact with the face plate 1017, substrate 1011 and connection members 1041 are formed with the low resistance intermediate layers.

(2) The intermediate films make uniform a potential distribution of the high resistance film 11.

Electrons emitted from the cold cathode element 1012 form an electron trajectory which matches the potential distribution formed between the face plate 1017 and substrate 1011. In order to prevent the electron trajectory from being disturbed near at the spacer 1020, it is necessary to control the potential distribution of the high resistance film 11 in the whole area thereof. If the high resistance film 11 is connected directly or via the connection members 1041 to the face plate (such as metal back 1019) and substrate 1011 (such as wiring lead 1013, 1014), the potential distribution is disturbed by the contact resistances at the connection interfaces so that the potential distribution of the high resistance film 11 may be displaced from the desired pattern. In order to avoid this, the spacer end portions (abut surface 3 and side surfaces 5) in contact with the face plate 1017, substrate 1011 and connection members 1041 are formed with the low resistance intermediate layers, and a desired potential is applied to the intermediate layers to thereby control the potential distribution of the whole of the high resistance film 11.

(3) The intermediate films control the trajectory of an emitted electron beam.

Electrons emitted from the cold cathode element 1012 form an electron trajectory matching the potential distribution formed between the face plate 1017 and substrate 1011. Electrons emitted from the cold cathode element near at the spacer may limit the mount position of the spacer and so the positions of wiring lead and element may be required to be changed. In such a case, it is necessary to control the trajectory of emitted electrons and apply electrons to a desired position of the face plate 1017 in order to form an image without distortion and disturbance. By forming the low resistance intermediate layers on the upper and lower side surfaces 5 of the spacer in contact with the face plate 1017 and substrate 1011, it is possible to have a desired potential distribution near the spacer 1020 and control the trajectory of emitted electrons.

The low resistance film 21 is set to have a resistance value sufficiently lower than that of the high resistance film 11. For example, $10^5$ Ωcm or lower is preferable, and $10^3$ Ωcm or smaller is more preferable. It is also preferable that the specific resistance is lower than by one digit than that of the high resistance film, or more preferably by two digits or larger. The material of the low resistance film 21 may be: metal such as Ni, Cr, Au, Mo, W, Pt, Ti, Al, Cu and Pd; alloy thereof; printed conductor constituted of glass and metal or metal oxide such as Pd, Ag, Au, $RuO_2$ and Pd—Ag; transparent conductor such as $In_2O_3$—$SnO_2$; and semiconductor material such as poly-silicon.

The connection member 1040 is preferably conductive in order to electrically connect the spacer 1020 to the row direction wiring lead 1013 and metal back 1019. The material is preferably conductive adhesive, metal particles, frit glass added with conductive filler.

Dx1 to Dxm, Dy1 to Dyn, and Hv are electrical connection terminals of a air-tight structure for electrically connecting the display panel to an unrepresented electric circuit. Dx1 to Dxm are electrically connected to the row direction wiring lines 1013 of the multi-electron beam source, Dy1 to Dyn are electrically connected to the column direction wiring lines 1014 of the multi-electron beam source, and Hv is electrically connected to the metal back 1019 of the face plate.

The inside of the air-tight envelope is evacuated to a vacuum degree of about $10^{-7}$ Torr, by using unrepresented exhaust pipe and vacuum pump after the air-tight envelope is assembled. Thereafter, the exhaust pipe is sealed. In order to maintain the vacuum degree of the air-tight envelope, a getter film (not shown) is formed at a predetermined position of the inside of the air-tight envelope immediately before or after the exhaust pipe is sealed. The getter film is formed by heating getter material having Ba as its main component with a heater or through high frequency heating to vapor deposit it. The absorption function of the getter film maintains the inside of the air-tight envelope at a vacuum degree of $1\times10^{-5}$ to $1\times10^{-7}$ Torr.

As a voltage is applied to each cold cathode element 3112 via the terminals Ds1 to Dxm and Dy1 to Dyn of the image display apparatus using the above-described display panel, electrons are emitted from each cold cathode element 1012. At the same time, a high voltage of several hundred V to several Kv is applied via the terminal Hv to the metal back 1019 to accelerate the emitted electrons and make them collide with the inner surface of the face plate 1017. The fluorescent materials of each color constituting the fluorescent film 1018 emit light and an image can be displayed.

If a surface conduction type emitting element is used as the cold cathode element 1012, generally a voltage to be applied to the surface conduction type emitting element is about 12 to 16 V, a distance d between the metal back 1019 and cold cathode element 1012 is about 0.1 to 8 mm, and a voltage to be applied across the metal back 1019 and cold cathode element 1012 is about 0.1 Kv to 10 Kv.

The fundamental structure and manufacture method of the display panel and the outline of the image display apparatus according to the embodiment of the invention have been described above.

Next, a method of manufacturing a multi-electron beam source used by the embodiment display panel will be described. The material and shape of each cold cathode element and its manufacture method are not limited so long as the multi-electron beam source to be used by the image display apparatus is an electron beam source wired by a simple matrix form. Therefore, other cold cathode elements such as surface conduction type emitting elements, FE type elements and MIM type elements may also be used.

Of these cold cathode elements, a surface conduction type emitting element is particularly suitable because the current situation requires a display apparatus having a large inexpensive display screen. More specifically, the electron emission characteristics of an FE type element are greatly influenced by the relative position and shapes of the emitter cone and gate electrode. Therefore, manufacture techniques with very high precision are necessary, which makes manufacturing a large, and inexpensive display screen difficult. An MIM type element is required to form thin and uniform insulating film and upper electrode, which is disadvantageous factors in realizing a large display screen and a manufacture cost reduction. An MIM type element is required to form a thin and uniform insulating film and an upper electrode, which also makes manufacturing a large and inexpensive display screen difficult. In contrast, a surface conduction type emitting element requires a relatively simple manufacture method which makes it easier to manufacture a large inexpensive display screen. The present inventors have found that a surface conduction type emitting element having an electron emission area or its peripheral area made of a fine particle film has excellent electron emission characteristics and is easy to manufacture. Surface conduction type emitting elements are therefore most suitable for use as the multi-electron beam source of an image display apparatus having a high luminance and a large display screen. The display panel of the embodiment uses surface conduction type emitting elements whose electron emission area and its nearby area are made of a fine particle film. The preferred fundamental structure and manufacture method of a surface conduction type emitting element will be first described and then the structure of a multi-electron beam source having a number of elements wired in a simple matrix form will be described.

Typical structures of a surface conduction type emitting element whose electron emission area and its nearby area are made of a fine particle film include two types, a horizontal type and a vertical type.

(Horizontal Type Surface Conduction Type Emitting Element)

First, the structure and manufacture method of a horizontal type surface conduction type emitting element will be described.

Figure 24A:
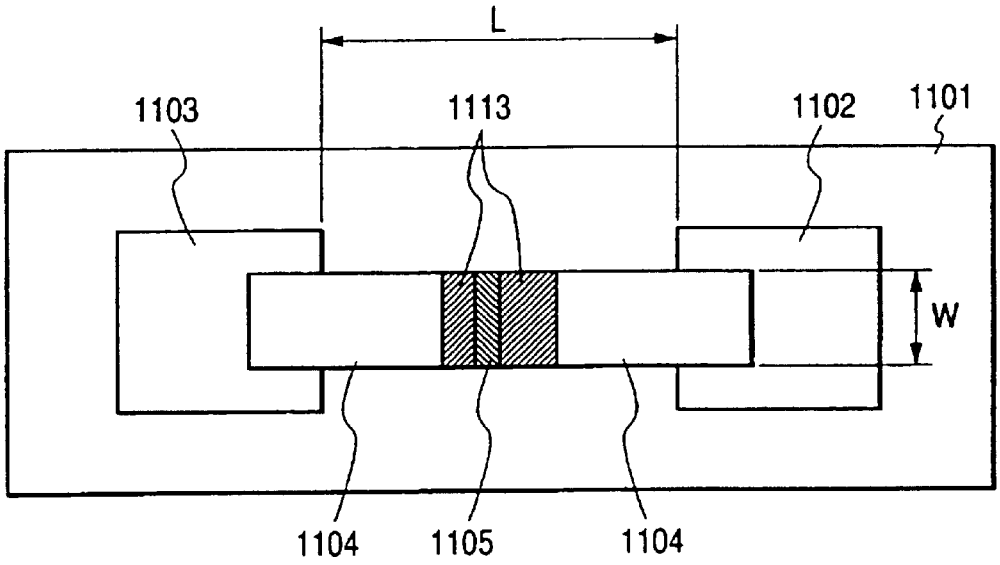
FIG. 24A is a plan view showing a flat panel type surface conduction type emitting element used by the embodiment.
Figure 24B:
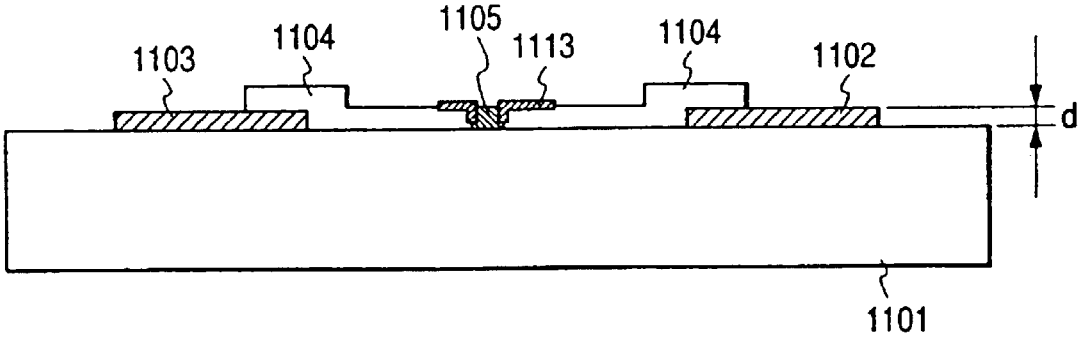
FIG. 24B is a cross sectional view of the element.

FIG. 24A is a plan view showing the structure of a horizontal type surface conduction type emitting element, and FIG. 24B is a cross sectional view of the element. In FIGS. 24A and 24B, reference numeral 1101 represents a substrate, reference numerals 1102 and 1103 represent element electrodes, reference numeral 1104 represents a conductive thin film, reference numeral 1105 represents an electron emission area formed by an electric energization forming process, and reference numeral 1113 represents a thin film formed by an electric energization activation process.

The substrate 1101 may be made of various types of glass substrates such as quartz glass and soda-lime glass, of various types of ceramic substrates such as alumina, and of these substrates laminated with an insulating film made of $SiO_2$.

The element electrodes 1102 and 1103 facing each other and formed on the substrate 1101 in parallel to the substrate surface are made of conductive material. The material may be any material selected from a group consisting of: metals such as Ni, Cr, Au, Mo, W, Pt, Ti, Cu, Pd, or alloys thereof; metal oxide such as $In_2O_3$, $SnO_2$; and semiconductor such as polysilicon. The electrode can be easily formed by a combination of, for example, film forming techniques such as vacuum vapor deposition and patterning techniques such as photolithography and etching. Other methods such as printing techniques may also be used.

The shape of the element electrodes 1102 and 1103 is designed in accordance with the application field of the electron emitting element. The electrode space L is generally designed in a range from several hundred angstroms to several hundred $\mu$m, or in a range from several $\mu$m to several ten $\mu$m preferable for the application to a display apparatus. A thickness d of the element electrode is designed in a range from several hundred angstroms to several $\mu$m.

The conductive thin film 1104 is made of a fine particle film. The fine particle film is intended to mean a film (including a collection of island particles) containing a number of fine particles as constituent elements. From a microscopic observation of the fine particle film, the film has generally the structure of fine particles disposed spaced apart from each other, the structure of fine particles disposed near each other, or the structure of fine particles superposed each other.

The diameter of a fine particle of the fine particle film is in the range from several angstroms to several thousand angstroms, or preferably in the range from 10 angstroms to 200 angstroms. The thickness of a fine particle film is set as desired by taking into consideration the various conditions: the conditions that the fine particle film can be electrically connected to the element electrodes 1102 and 1103 in a good state; the conditions that the electric energization forming process to be described later can be properly executed; the conditions that the electrical resistance of the fine particle film can be set to a proper value; and other conditions. The diameter of a fine particle is set in the range from several angstroms to several thousand angstroms, or preferably in the range from 10 angstroms to 500 angstroms.

The material of the fine particle film may be any material selected from a group consisting of: metals such as Pd, Pt, Ru, Ag, Au, Ti, In, Cu, Cr, Fe, Zn, Sn, Ta, W, and Pb; oxides such as PdO, $SnO_2$, $In_2O_3$, PbO, and $Sb_2O_3$; borides such as $HfB_2$, $ZrB_2$, $LaB_6$, $CeB_6$, $YB_4$, and $GdB_4$; carbides such as TiC, ZrC, HfC, TaC, SiC, and WC; nitrides such as TiN, ZrN, and HfN; semiconductors such as Si and Ge; and carbon.

As described above, the sheet resistance of the fine particle film of the conductive thin film 1104 was set in the range from $10^3$ to $10^7$ $\Omega$/sq.

It is desired that the conductive thin film 1104 is electrically connected to the element electrodes 1102 and 1103 in a proper state. The conductive thin film 1104 is therefore partially superposed upon the element electrodes 1102 and 1103. In the example shown in FIGS. 24A and 24B, this superposition is realized by a lamination of the substrate, element electrodes, conductive thin film in this order from the bottom. The lamination may be made of the substrate, conductive thin film, and element electrodes in this order from the bottom.

The electron emission area 1105 is made of cracks partially formed in the conductive thin film 1104 and has an electrical resistance higher than the peripheral conductive thin film. The cracks are formed in the conductive thin film 1104 by the electric energization forming process to be described later. Fine particles having a diameter of several angstroms to several hundred angstroms are disposed in some cases in the cracks. Since it is difficult to precisely and correctly draw the position and shape of the electron emission area, these are schematically shown in FIGS. 24A and 24B.

The thin film 1113 is made of carbon or carbon compound and covers the electron emission area 1105 and its nearby area. The thin film 1113 is formed by the electric energization activation process to the described later after the electric energization forming process is executed.

The thin film 1113 is made of single crystal graphite, polycrystalline graphite or amorphous carbon, or their mixture. The thickness of the thin film 1113 is preferably set to 500 angstroms or thinner, or more preferably 300 angstroms or thinner. Since it is difficult to precisely draw the position and shape of the thin film 1113, these are schematically shown in FIGS. 24A and 24B.

The preferred fundamental structure of the element has been described. In the embodiment, the following element were used.

The substrate 1101 was made of soda lime glass, the element electrodes 1102 and 1103 were made of an Ni thin film. The thickness d of the element electrode was set to 1000 angstroms, and the space L between the electrodes was set to 2 $\mu$m.

The main components of the fine particle film were Pd or PdO, the thickness of the fine particle film was set to about 100 angstroms and the width W thereof was set to 100 $\mu$m.

Next, a preferred method of manufacturing a horizontal type surface conduction type emitting element will be described.

FIGS. 25A to 25D are cross sectional views illustrating the processes of manufacturing a surface conduction type emitting element, the elements thereof being represented by identical reference numerals to those used in FIGS. 24A and 24B.

Figure 25A:
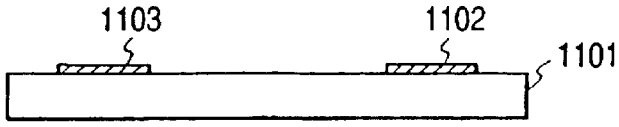
FIGS. 25A, 25B, 25C, 25D and 25E are cross sectional views illustrating the processes of manufacturing a flat panel type surface conduction emitting element.

(1) First, as shown in FIG. 25A, element electrodes 1102 and 1103 are formed on a substrate 1101.

In forming the element electrodes 1102 and 1103, the substrate 1101 is first cleaned sufficiently with cleaning agent, pure water and organic solvent. Thereafter, material of the element electrode is deposited through, for example, vacuum film forming techniques such as vapor deposition and sputtering. Thereafter, the deposited electrode material is patterned through photolithography/etching techniques to form a pair of element electrodes 1102 and 1103 shown in FIG. 25A.

Figure 25B:
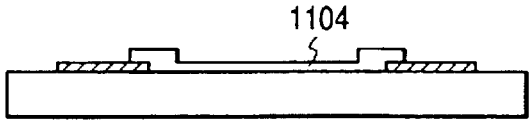

(2) Next, a conductive thin film 1104 is formed as shown in FIG. 25B.

In forming the conductive thin film 1104, organic metal solution is coated on the surface of the substrate formed with a pair of element electrodes 1102 and 1103 shown in FIG. 25A and heated and baked to form a fine particle film. This fine particle film is patterned into a predetermined shape through photolithography/etching. The organic metal solution is a solution of organic metal compound having as its main components fine particle material of the conductive thin film. In this embodiment, Pd was used as the main components. Also in this embodiment, the organic metal solution was coated by a dipping method. Other methods such as a spinner method and a spray method may also be used.

As a method of forming the conductive thin film made of a fine particle film, instead of coating the organic metal solution as in the embodiment, vacuum vapor deposition, sputtering, or chemical vapor deposition may also be used.

Figure 25C:
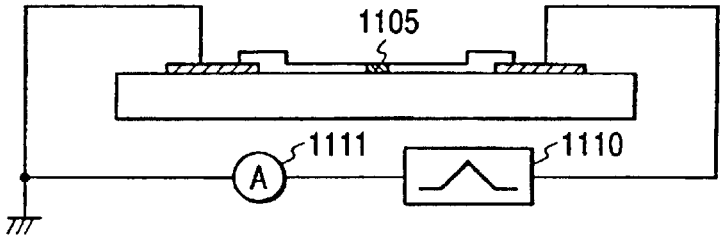

(3) Next, as shown in FIG. 25C, an electric energization forming process is executed to form an electron emission area 1105, by applying a proper voltage between the element electrodes 1102 and 1103 from a forming power source 1110.

The electric energization forming process is a process of electrically energizing the conductive thin film 1104 made of a fine particle film to partially destroy, deform or decompose the conductive thin film and transform the structure of the film into a structure suitable for electron emission. The structure of the conductive thin film made of a fine particle film transformed suitable for electron emission (i.e., electron emission area 1105) is formed with proper cracks. As compared to the state before the electron emission area 1105 is formed, the electrical resistance between the element electrodes 1102 and 1103 measured after the electron emission area 1105 is formed increases considerably.

Figure 26:
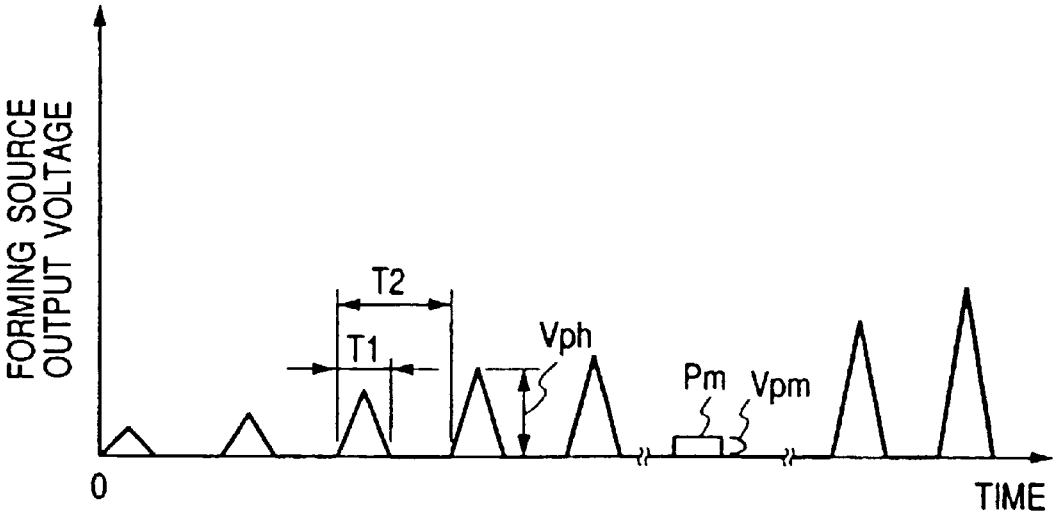
FIG. 26 is a graph showing the waveforms of an application voltage used for an electric energization forming process.

Examples of proper waveforms of a voltage to be applied from the forming power source 1111 are shown in FIG. 26 in order to describe the electric energization forming process in more detail. A voltage used for the forming process of the conductive thin film made of a fine particle is preferably a pulse voltage. As shown in FIG. 26, in this embodiment, triangular pulses having a pulse width T1 were applied consecutively at a pulse interval of T2. In this case, the peak value Vpf of the triangular pulse was gradually raised. Monitor pulses Pm for monitoring the forming state of the electron emission area 1105 were inserted between the triangular pulses at a proper interval, and current was measured with an ammeter 1111.

In this embodiment, for example, the electric energization forming process was executed under the conditions of a vacuum atmosphere of about $10^{-5}$ Torr, a pulse width T1 of 1 msec, a pulse interval T2 of 10 msec, and a peak voltage Vps rise of 0.1 V per one pulse. The monitor pulse Pm was inserted each time five triangular pulses were applied. In order to adversely affect the forming process, a voltage Vpm of the monitor pulse was set to 0.1 V. When the electrical resistance between the element electrodes 1102 and 1103 was $1\times10^{6}\Omega$, i.e., when the current of the monitor pulse measured with the ammeter 1111 was 1×10−7A or smaller, the electric energization forming process was terminated.

This embodiment method is a preferable method of forming a surface conduction type emitting element. If the design of a surface conduction type emitting element is changed, for example, if the material and thickness of the fine particle film and the element electrode space L are changed, it is preferable to properly change the conditions of the electric energization forming process.

Figure 25D:
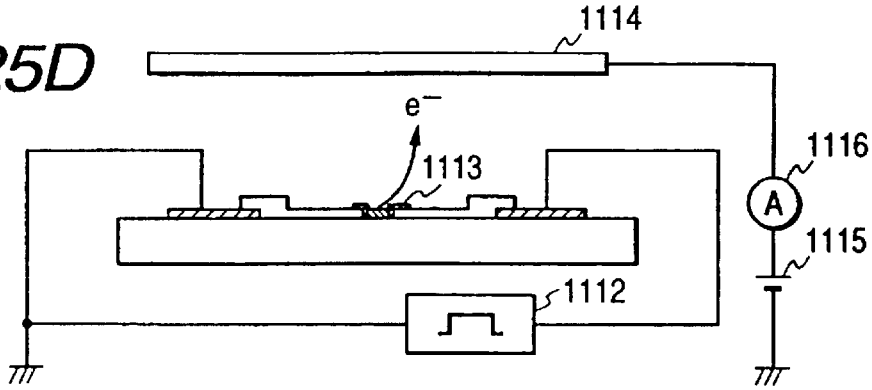

(4) Next, as shown in FIG. 25D, the electric energization activation process is executed to improve the electron emission characteristics, by applying a proper voltage between the element electrodes 1102 and 1103 from an activation power source 1112.

The electric energization process is a process of depositing carbon or carbon compound on an area near the electron emission area 1105, by electrically energizing the electron emission area 1105 formed by the electric energization forming process. In FIG. 25D, deposits of carbon or carbon compound are schematically shown as a member 1113. The emission current at the same application voltage was able to be increased typically by 100 times as compared with the current measured before the electric energization activation process.

More specifically, voltage pulses were periodically applied in a vacuum atmosphere in the range from $10^{-4}$ to $10^{-5}$ Torr to deposit carbon or carbon compounds by using organic compounds in the vacuum atmosphere as source materials. The deposits 1113 are made of single crystal graphite, polysilicon graphite, or amorphous carbon or their mixture. The film thickness is 500 angstroms or thinner, or more preferably 300 angstroms or thinner.

Figure 27A:
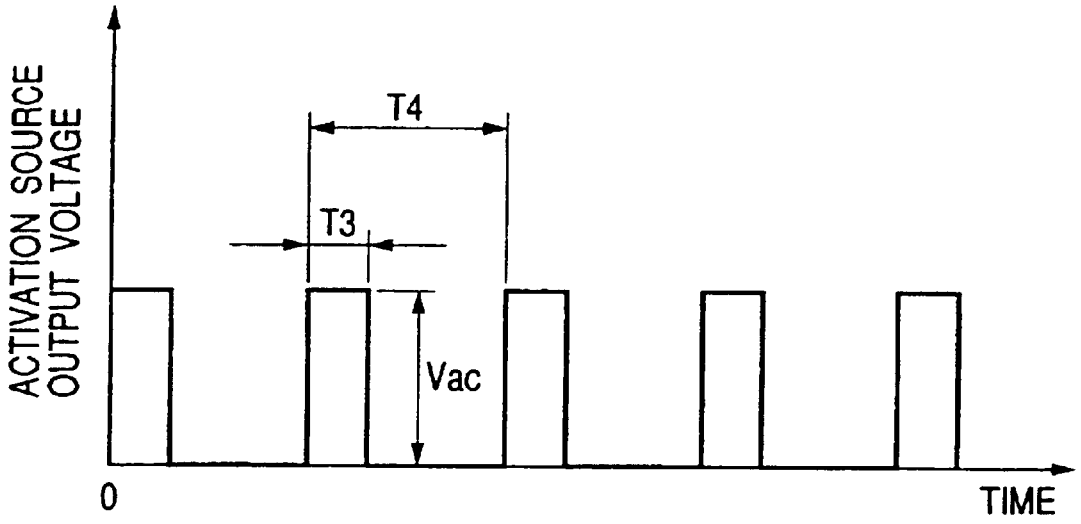
FIG. 27A is a diagram showing the waveforms of an application voltage used for an electric energization activation process.

Examples of proper waveforms of a voltage to be applied from the activation power source 1112 are shown in FIG. 27A in order to describe the electric energization activation process in more detail. In this embodiment, the electric energization process was executed by periodically applying a rectangular pulse having a constant voltage. More specifically, a voltage Vas of the rectangular pulse was set to 14 V, a pulse width T3 was set to 1 msec, and a pulse interval T4 was set to 10 msec. This embodiment method is a preferable method of forming a surface conduction type emitting element. If the design of a surface conduction type emitting element is changed, it is preferable to properly change the conditions of the electric energization activation process.

Figure 27B:
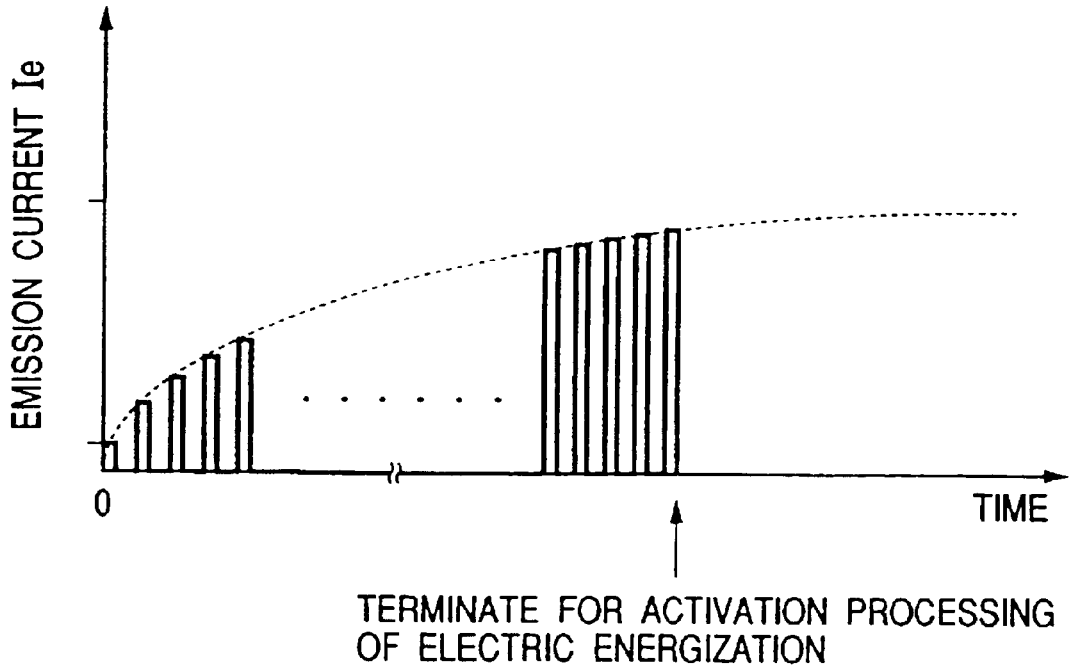
FIG. 27B is a graph showing a change in an emission current Ie.

Reference numeral 1114 in FIG. 25D represents an anode electrode for measuring a current Ie of electrons emitted from the surface conduction type emitting element. A d.c. high voltage source 1115 and an ammeter 1116 are connected to the anode electrode 1114. If the activation process is executed after the substrate 1101 is assembled in a display panel, the fluorescent screen of the display panel may be used as the anode electrode 1114. While a voltage is applied from the activation power source 1112, the emission current Ie is measured with the ammeter 1116 to monitor a progress state of the electric energization process and control the operation of the electric energization power source 1112. An example of the emission current Ie measured with the ammeter 1116 is shown in FIG. 27B. As the pulse voltage starts being applied from the activation power source 1112, the emission current Ie increases as the time lapses and eventually saturates and rarely increases. When the emission current Ie becomes approximately saturated, a voltage application from the activation power source is terminated to stop the electric energization activation process.

In the aforesaid embodiment electric energization conditions are preferably the same as the conditions for forming a surface conduction type emitting element. If the design of a surface conduction type emitting element is changed, it is preferable to properly change the conditions of the electric energization.

Figure 25E:
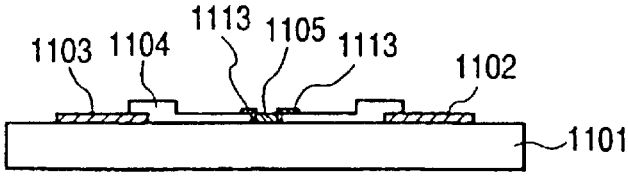

The horizontal type surface condition type emitting element shown in FIG. 25E was manufactured in the above manner.

(Vertical Type Surface Conduction Type Emitting Element)

Next, another typical structure of the surface conduction type emitting element having a fine particle film formed in the electron emission area and its nearby area, i.e., the structure of a vertical type surface conduction type emitting element, will be described.

Figure 28:
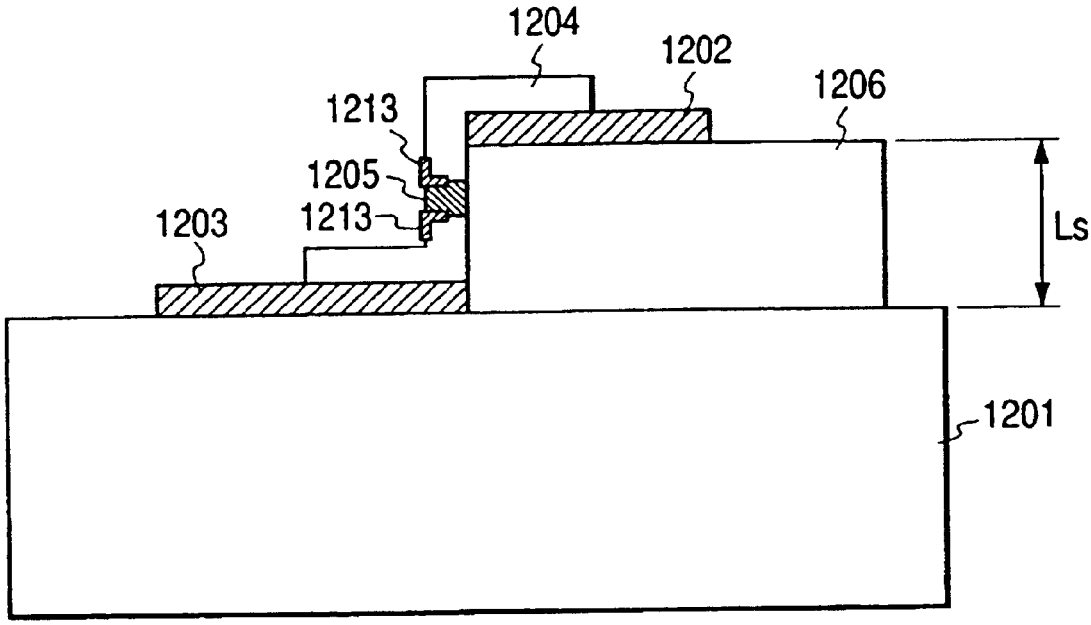
FIG. 28 is a cross sectional view of a vertical type surface conduction emitting element used by the embodiment.

FIG. 28 is a schematic cross sectional view showing the fundamental structure of a vertical type surface conduction emitting element. In FIG. 28, reference numeral 1201 represents a substrate, reference numerals 1202 and 1203 represent element electrodes, reference numeral 1206 represents a step forming member, reference numeral 1204 represents a conductive thin film made of a fine particle film, reference numeral 1205 represents an electron emission area formed by an electric energization forming process, and reference numeral 1213 represents a thin film formed by an electric energization activation process.

Different points of the vertical type element from the horizontal type element described earlier are that one of the element electrodes 1202 is formed on the step forming member 1206 and the conductive thin film 1204 covers the side of the step forming member 1206. Therefore, the element electrode space L of the horizontal element shown in FIGS. 24A and 24B are defined in the vertical type element as a step height Ls of the step forming member 1206. The materials of the substrate 1201, element electrodes 1202 and 1203 and conductive thin film 1204 made of a fine particle film may use those materials of the horizontal type element described earlier. The step forming member 1206 is made of electrically insulating material such as $SiO_2$.

Next, a method of manufacturing a vertical type surface conduction type emitting element will be described. FIGS. 29A to 29F are cross sectional views illustrating the manufacture processes, each component being represented by the identical reference numeral to that used in FIG. 28.

Figure 29A:
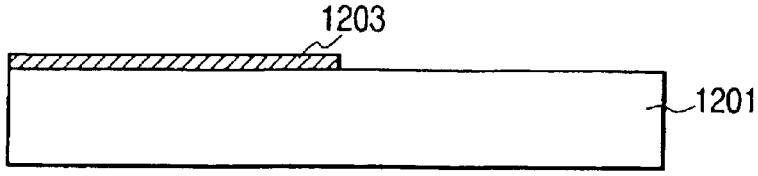
FIGS. 29A, 29B, 29C, 29D, 29E and 29F are cross sectional views illustrating the processes of manufacturing a vertical type surface conduction emitting element.

(1) First, as shown in FIG. 29A, an element electrode 1203 is formed on a substrate 1201.

Figure 29B:
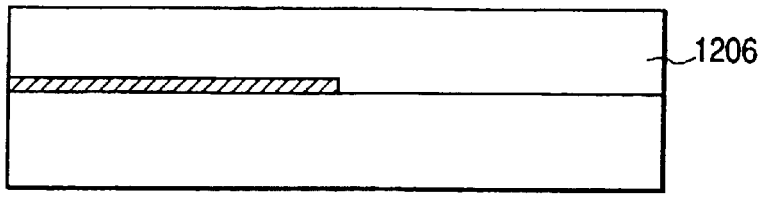

(2) Next, as shown in FIG. 29B, an insulating layer is laminated in order to form a step forming member. The insulating layer may be laminated by sputtering $SiO_2$, or may be formed by any other methods such as vacuum vapor deposition and printing.

Figure 29C:
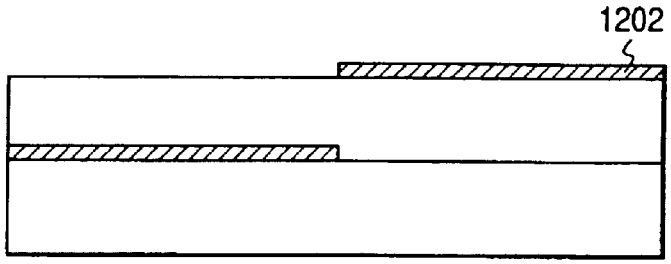

(3) Next, as shown in FIG. 29C, an element electrode 1202 is formed on the insulating layer.

Figure 29D:
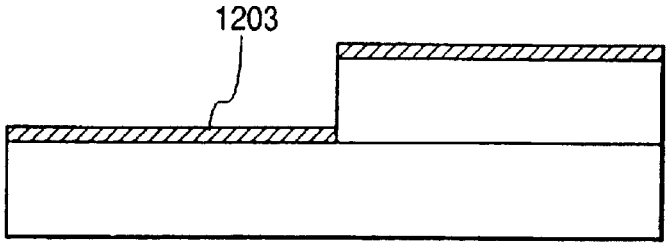

(4) Next, as shown in FIG. 29D, a portion of the insulating layer is removed, for example, by etching, to expose the element electrode 1203.

Figure 29E:
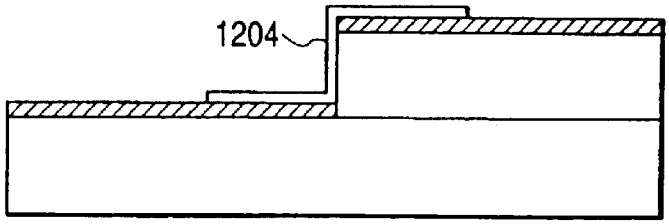

(5) Next, as shown in FIG. 29E, a conductive thin film 1204 is formed by using a fine particle film. Similar to the horizontal type element, this conductive thin film 1204 may be formed by a film forming method such as coating.

(6) Next, similar to the horizontal type element, an electric energization forming process is executed to form an electron emission area (a process similar to the electric energization forming process for a horizontal type element described with reference to FIG. 25C is executed).

(7) Next, similar to the horizontal type element, an electric energization activation process is executed to deposit carbon or carbon compound (a process similar to the electric energization activation process for a horizontal type element described with reference to FIG. 29D is executed).

Figure 29F:
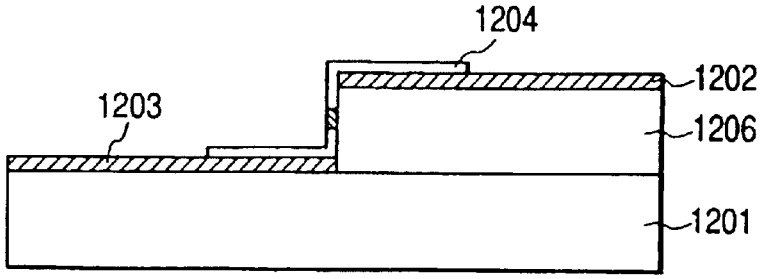

In the above manner, the vertical type surface conduction type emitting element shown in FIG. 29F is manufactured.

(Characteristics of a Surface Conduction Type Emitting Element Used with a Display Apparatus)

The structures and manufacture methods of horizontal and vertical type conduction emitting elements have been described above. Next, the characteristics of an element used with a display apparatus will be described.

FIG. 20 shows typical characteristics of (emission current Ie) relative to (element voltage Vf) and typical characteristics of (element current If) relative to (element voltage Vf) of an element used with a display apparatus. The emission current Ie is considerably smaller than the element current If and they are difficult to shown at the same scale. Therefore, these currents are shown at optional scales in the graph of FIG. 30.

The element used with the display apparatus has the following three features of the emission current Ie.

First, as a voltage higher than a certain voltage (called a threshold voltage Vth) is applied to the element, the emission current Ie increases abruptly, whereas as a voltage not higher than the threshold voltage Vth is applied, the emission current is hardly detected. Namely, the element is a non-linear element having a definite threshold voltage Vth relative to the emission current.

Second, since the emission current Ie changes with the voltage Vf applied to the-element, the amount of the emission current Ie can be controlled by the element voltage Vf.

Third, a response speed of the emission current Ie to the element voltage Vf is fast. It is therefore possible to control the charge amount of electrons emitted from the element in accordance with the time duration while the voltage Vf is applied.

Since a surface conduction type emitting element has the above-described features, it is possible to use it with the display apparatus. For example, in a display apparatus having a number of elements in correspondence with pixels of a display screen, an image can be displayed by sequentially scanning the display screen by utilizing the first feature. Namely, a proper voltage equal to or higher than the threshold voltage Vth corresponding to a desired pixel luminance is applied to the element to be driven, while a voltage not higher than the threshold voltage Vth is applied to elements not selected. By sequentially changing an element to be driven, it is possible to display an image by sequentially scanning the display screen.

By utilizing the second or third feature, a pixel luminance can be controlled so that a gradation display of an image is possible.

Figure 31:
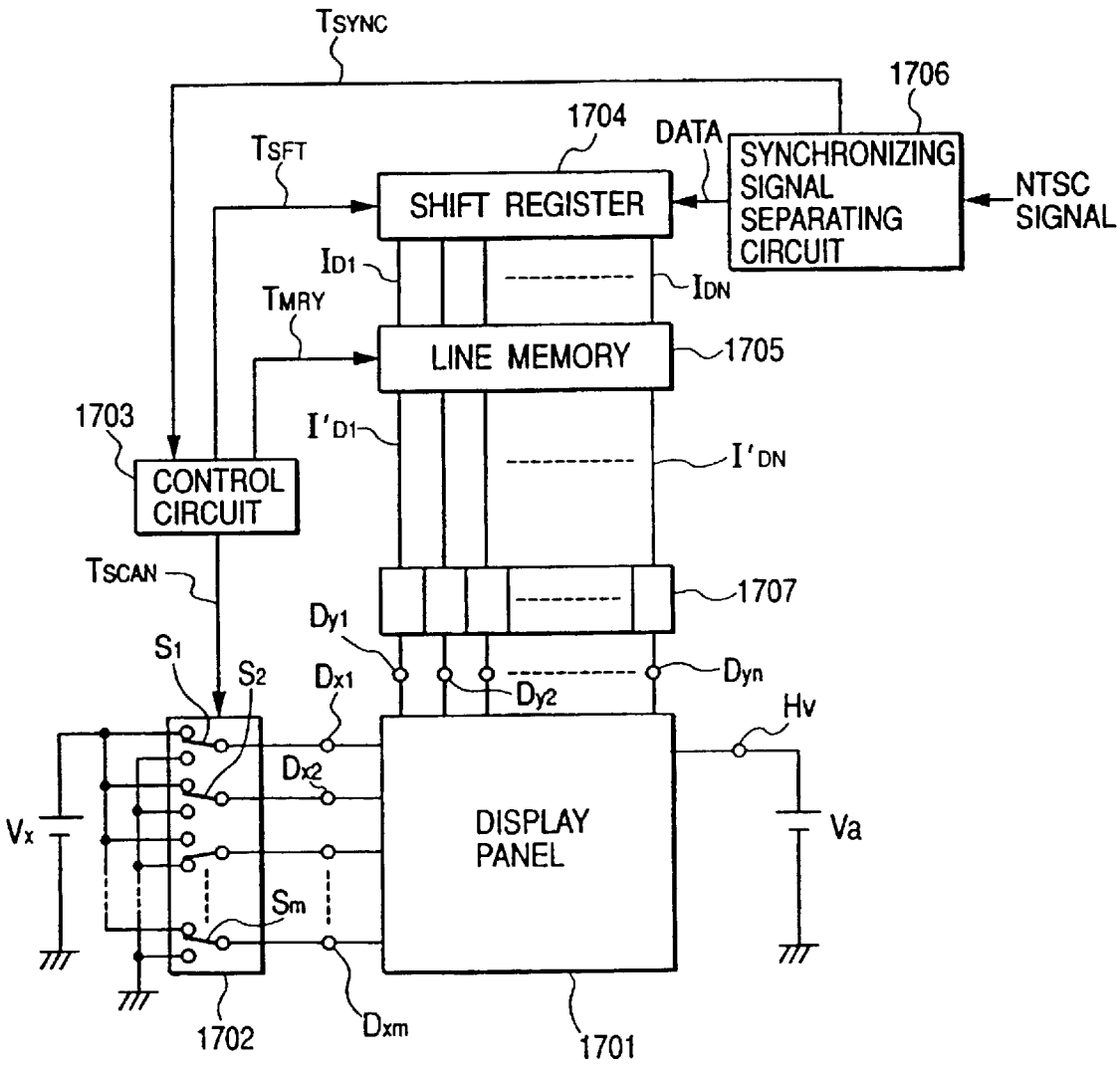
FIG. 31 is a block diagram showing the outline structure of a drive circuit for an image display apparatus according to an embodiment of the invention.

FIG. 31 is a block diagram showing the outline structure of a drive circuit used for displaying an image by using a television signal of an NTSC. system. In FIG. 31, a display panel 1701 corresponds to the above-described display panel and is manufactured and operated in the manner described earlier. A scanner circuit 1702 scans display lines, and a control circuit 1703 generate a signal to be supplied to the scanner circuit 1702 and other signals. A shift register 1704 shifts data of one line, and a line memory 1705 supplies data of one line supplied from the shift register 1704 to a modulating signal generator 1707. A sync signal separating circuit 1706 separates a sync signal from an NTSC signal.

The function of each element of the display apparatus shown in FIG. 31 will be described in detail. The display panel 1701 is connected to an external electric circuit via terminals Dx1 to Dxm, terminals Dy1 to Dyn, and a high voltage terminal Hv. Of these terminals, the terminals Dx1 to Dxm are applied with scan signals for sequentially driving a multi electron beam source of the display panel 1701, i.e., cold cathode elements wired in a matrix form of m rows and n columns, one row (n elements) after another. The terminals Dy1 and Dyn are applied with modulating signals for controlling an output electron beam of each of the n elements of one row selected by each scan signal. The high voltage terminal Hv is applied with a high d.c. voltage, for example, 5 Kv from a d.c. voltage source Va. This voltage is used as an acceleration voltage for supplying each electron beam output from the multi electron beam source with an energy sufficient for exciting the fluorescent materials.

Next, the scanner circuit 1702 will be described. This circuit 1702 has m switching elements (schematically shown as S1 to Sm in FIG. 31) each selecting either an output voltage from a d.c. voltage source Vx or 0 V (ground level) and supplying the selected voltage to each of the terminals Dx1 to Dxm of the display panel 1701. Each of the switching elements S1 to Sm operates in response to a control signal Tscan output from the control circuit 1703 and can be realized easily by a combination of switching elements such as FET's. The d.c. voltage source Vx is designed based upon the characteristics of the cold cathode element shown in FIG. 30 so that it can output a constant voltage not higher than the electron emission threshold voltage Vth and supply it as a drive voltage to the non-selected elements.

The control circuit 1703 operates to match the operation timings of respective components in order to properly display an image in accordance with an image signal externally supplied. In accordance with a sync signal Tsync to be described in detail below and supplied from the sync signal separating circuit 1706, the control circuit 1703 generates various control signals including Tscan, Tsft and Tmry and supplies them to various components. The sync signal separating circuit 1703 is a circuit for separating an externally input NTSC television signal into sync signal components and luminance signal components. As well known, this circuit 1706 can be realized easily by using a frequency separating (filter) circuit. The sync signal separated by the sync signal separating circuit 1706 includes a vertical sync signal and a horizontal sync signal as well known in the art. For the simplicity of description, these sync signals are represented collectively by the Tsync signal. The luminance signal components separated from the television signal are collectively represented by a DATA signal also for the simplicity of description. The DATA signal is input to the shift resister 1704.

The shift resister 1704 serial/parallel converts the image DATA signal of each line time sequentially and serially input, in response to the control signal Tsft supplied from the control circuit 1703. This control signal Tsft functions, therefore, as a shift clock of the shift register 1704. The image data of one line (drive data of n elements) serial/parallel converted is output from the shift register 1704 as n signals including Idl to Idn.

The line memory 1705 stores the image data Idl to Idn of one line for a necessary time in response to the control signal Tmry supplied from the control circuit 1703. The stored data is output as I'dl to I'dn to the modulating signal generator 1707.

The modulating signal generator 1707 is a signal source for properly modulating each of the cold cathode elements 1012 in accordance with the image data I'dl to I'dn. Each output signal from the modulating signal generator 1707 is applied to each of the cold cathode elements 1012 in the display panel 1701 via the terminals Dyl to Dyn.

Figure 30:
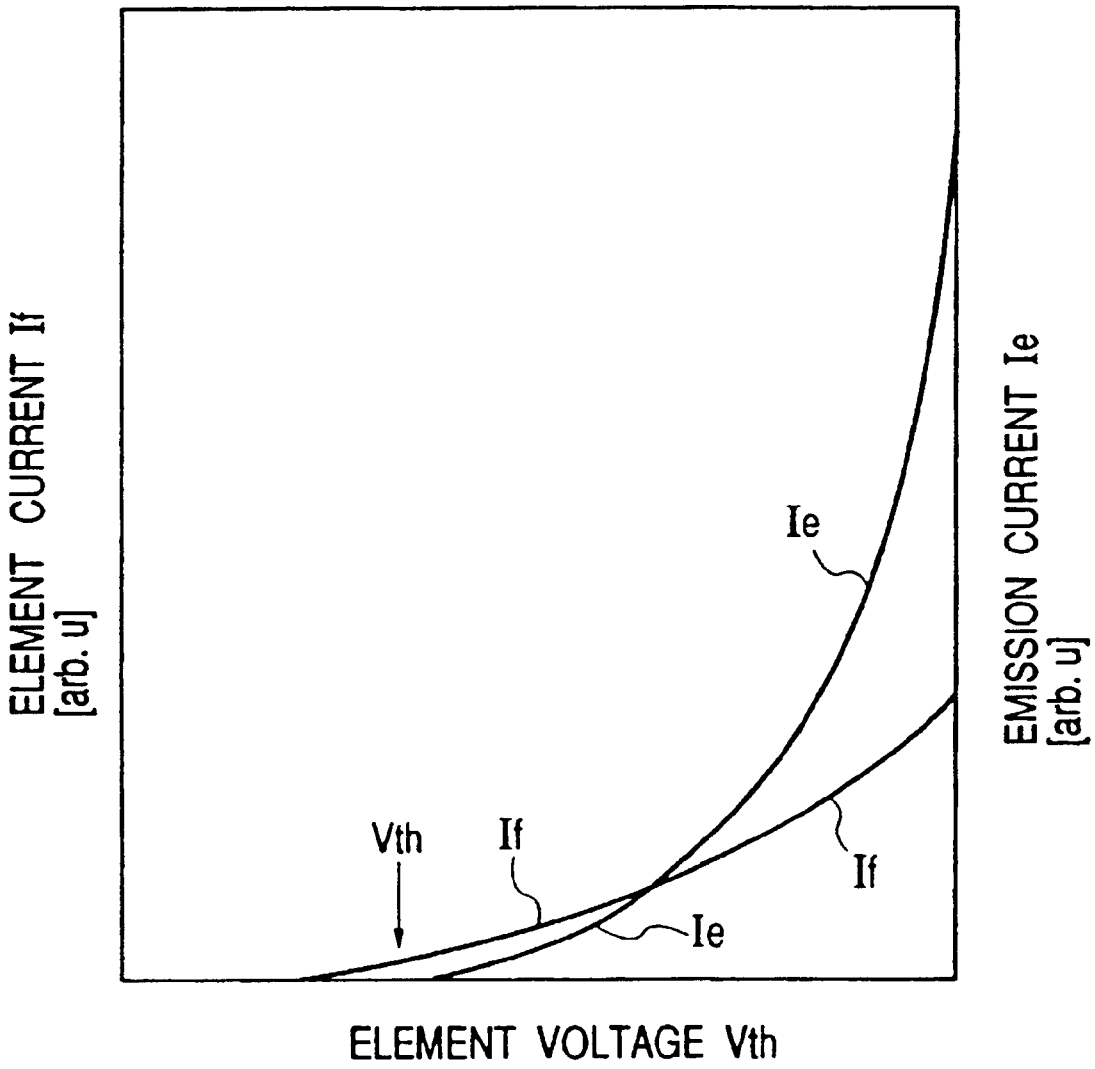
FIG. 30 is a graph showing typical characteristics of a surface conduction type emitting element used by the embodiment.

As described with reference to FIG. 30, the surface conduction type emitting element has the following fundamental features regarding the emission current Ie. A definite threshold voltage Vth (8 V for a surface conduction type emitting element of embodiments to be later described) is rightly associated with electron emission, and if only a voltage equal to or higher than the threshold voltage Vth is applied, electron emission occurs. The emission current Ie changes with a voltage equal to or higher than the threshold voltage Vth, as shown in the graph of FIG. 30. Therefore, if a pulse voltage not higher than the electron emission threshold voltage Vth is applied to a surface conduction type emitting element, electron emission will not occur, whereas if a voltage equal to or higher than the electron emission threshold voltage Vth is applied, an electron beam is output from the surface conduction type emitting element. The intensity of the output electron beam can be controlled by changing the pulse voltage peak Vm. By changing the pulse width Pw, the total amount of charges of an output electron beam can be controlled.

As a method of modulating a surface conduction type emitting element in accordance with an input signal, a voltage modulating method, a pulse width modulating method and the like can be adopted. In the case of the voltage modulating method, as the modulating signal generator 1707, a voltage modulating type circuit can be used which generates a voltage pulse having a constant pulse width and changes the pulse peak value in accordance with input data. In the case of the pulse width modulating method, as the modulating signal generator 1707, a pulse width modulating type circuit can be used which generates a voltage pulse having a constant peak value and changes the width of the voltage pulse in accordance with input data.

The shift register 1704 and line memory 1705 may be of either a digital signal type or an analog signal type, if serial/parallel conversion of an image signal and image signal storage can be performs at a predetermined speed.

If the digital signal type is used, it is necessary to convert an output signal DATA from the sync signal separating circuit 1706 into digital signals. This can be made by using an A/D converter provided at an output stage of the sync signal separating circuit 176. The circuit structure of the modulating signal generator 1707 slightly changes with whether an output signal of the line memory 1705 is digital or analog. More specifically, if a digital signal is used for voltage modulation, for example, a D/A converter is used as the modulating signal generator 1707 and if necessary an amplifier circuit is added. If a digital signal is used for pulse width modulation, for example, as the modulating signal generator 1701, a combination of a high speed oscillator, a counter for counting a wave number of an output of the oscillator and a comparator for comparing an output of the counter with an output of the line memory is used. If necessary, an amplifier circuit is used for amplifying a pulse width modulated signal output from the comparator to a level of a drive voltage necessary for the cold cathode element.

If an analog signal is used for voltage modulation, as the modulating signal generator 1707, for example, an amplifier circuit using an operational amplifier can be adopted, and if necessary a shift level circuit is added. If an analog signal is used for pulse width modulation, for example, a voltage controlled oscillator (VCO) can be adopted, and if necessary an amplifier circuit is added which amplifies an voltage output from VCO to a level of a drive voltage necessary for the cold cathode element.

In an image display apparatus having the above-described structure and being applicable to the invention, electron emission occurs when a voltage is applied to each cold cathode element via the external terminals Dxl to Dxm and Dyl to Dyn. A high voltage is applied to the metal back 1019 or transparent electrode (not shown) via the high voltage terminal Hv to accelerate each electron beam. Accelerated electrons collide with the fluorescent film 1018 to emit light and form an image.

The structure of the image display apparatus described above is only an illustrative example of the image forming apparatus applicable to the invention. Various modifications become possible from the concept of this invention. An input signal is not limited only to an NTSC signal, but other signals may also be utilized, such as PAL signals, SECAM signals, and TV signals having scan lines larger than PAL and SECAM (such as high definition TV signals including MUSE signals).

Next, an electron source of a ladder layout type and an image forming apparatus using such an electron source will be described with reference to FIGS. 32 and 33.

Figure 32:
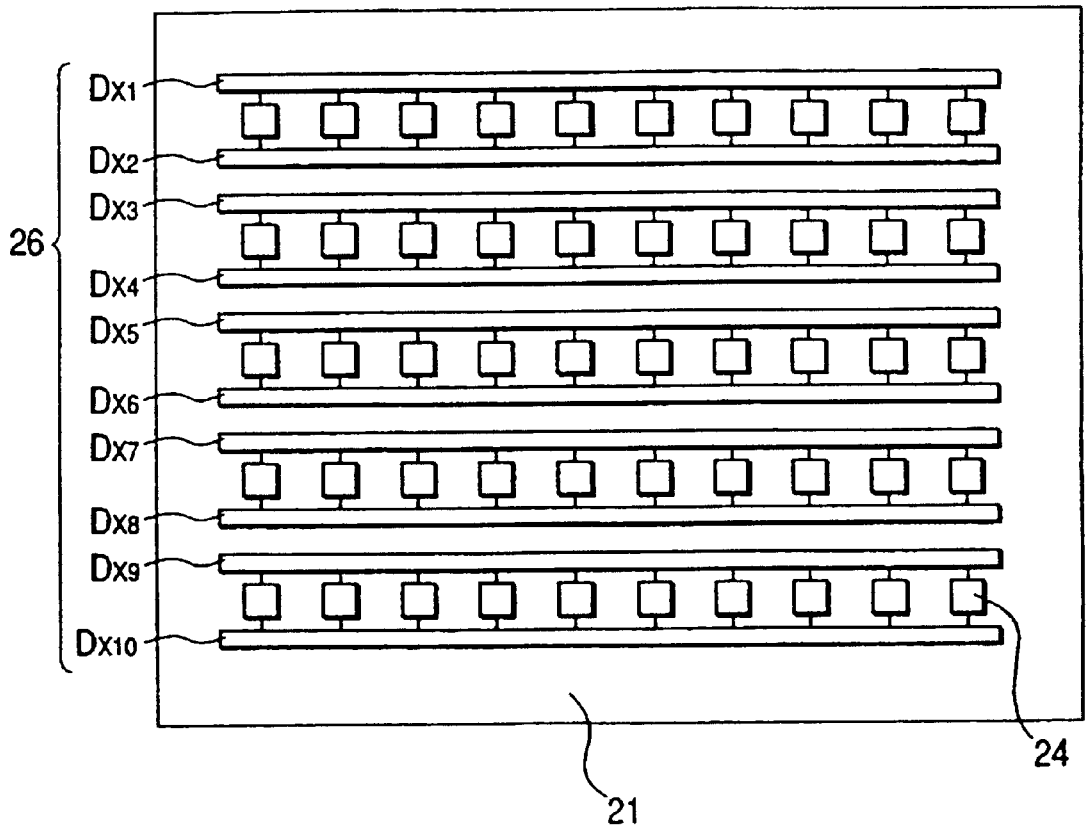
FIG. 32 is a schematic diagram showing an example of an electron beam source of a ladder layout type.

FIG. 32 is a schematic diagram showing an example of an electron source of a ladder layout type. In FIG. 32, reference numeral 21 represents an electron source substrate, and reference numeral 24 represents an electron emission element. Reference numeral 26 represents a common wiring lead for the connection to electron emission elements 24, the common wiring leads 26 including Dx1 to Dx10. A plurality row of electron emission elements 22 are disposed on the substrate 21 in parallel to an X-direction. Each row is called an element row. A plurality of element rows constitute the electron source. As a drive voltage is applied across adjacent common wiring leads of each element row, the element row can be driven independently from other element rows. Namely, a voltage equal to or higher than the electron emission threshold voltage is applied to an element row from which an electron beam is to be radiated, and a voltage not higher than the electron emission threshold voltage is applied to element rows from which an electron beam is not to be radiated. The common wiring leads Dx2 to Dx9 between adjacent element rows may be shared, for example, the wiring leads Ds2 and Dx3 may be formed by a single lead.

Figure 33:
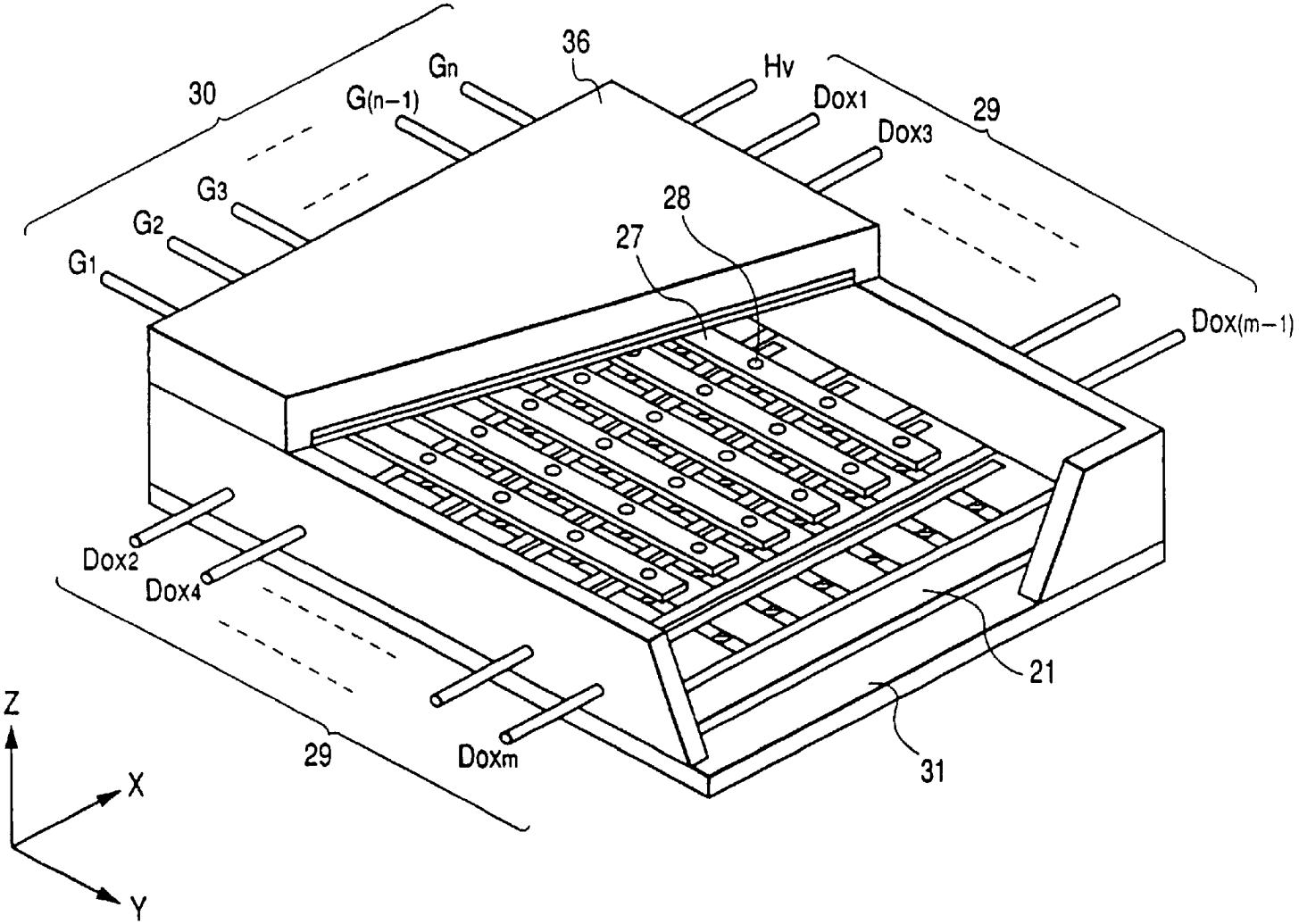
FIG. 33 is a perspective view showing an example of the panel structure of an image forming apparatus having an electron beam source of a ladder layout type.

FIG. 33 is a schematic view showing an example of the panel structure of an image forming apparatus having an electron source of the ladder layout type. In FIG. 33, reference numeral 27 represents a grid electrode, reference numeral 28 represents an opening through which electrons pass, and reference numeral 29 represents an external terminal including Dox1, Dox2, . . . , Doxm terminals. Reference numeral 30 represents an external terminal connected to the grid electrode, the terminal 30 including G1, G2, . . . , Gn terminals. In FIG. 33, like elements to those shown in FIG. 32 are represented by using identical reference numerals. A main different point of the image forming apparatus shown in FIG. 33 from the image forming apparatus of a simple matrix form shown in FIGS. 19 and 20 is that the grid electrode 27 is disposed between the electron source substrate 21 and face plate 36.

The grid electrode 27 modulates an electron beam radiated from each surface conduction type emitting element. In this example, the grid electrode 27 has a stripe shape perpendicular to the element row of the ladder layout type and is formed with openings 28 each corresponding to each surface conduction type emitting element. The shape and position of the grid 27 are not limited only to those shown in FIG. 33. For example, openings may be meshed openings formed in a grid plate, or each grid may be disposed about or near at each surface conduction type emitting element.

The external terminals 29 and 30 are electrically connected to an unrepresented control circuit.

(Embodiments)

A method of forming a spacer which is characteristic to this invention will be further described with reference to the following embodiments.

In each of the following embodiments, as the multi electron beam source, N×M (N=3072, M=1024) surface conduction type emitting elements each having an electron emission area in the conductive film between electrodes are wired by M row direction wiring leads and N column direction wiring leads in a matrix form (refer to FIGS. 19 and 20).

(First Embodiment)

In this embodiment, an image forming apparatus will be described in which a small amount of current is made to flow through a spacer to thereby eliminate charge accumulation.

FIG. 1 shows a spacer base member made of aluminum and formed with an intermediate layer and a high resistance film. In FIG. 1, reference numeral 11 represents a spacer base member, reference numeral 12 represents a high resistance film, reference numeral 13 represents an intermediate layer, and reference numeral 14 represent a cut portion.

First, the spacer base member 11 was formed by baking a green sheet containing alumina as its main components and formed with a doctor blade. The green sheet is at a condensated state but is not completely hardened. In this embodiment, the spacer base member 11 used was 70 mm square and 0.2 mm in thickness.

Next, on both sides of the spacer base member 11, high resistance films were formed in the following manner.

Ti and Al targets were sputtered at the same time by using high frequency power sources to form Ti—Al nitride films on both sides of the spacer base member 11. As the sputtering gas, a mixed gas of $Ar:N_2=1:2$ was used at a total pressure of 1 mTorr. By adjusting the high frequency powers supplied to the Ti and Al targets, the specific resistance of the nitride film was controlled. On the surface of the Ti—Al nitride film having a thickness of 150 nm, a nickel oxide film was formed by sputtering to a thickness of 22 nm.

In this embodiment, the surface resistance value of the high resistance film 12 was $5\times10^9\Omega/\square$.

Next, the intermediate layers 13 were formed on the spacer base member 11 formed with the high resistance layers 12. The intermediate layers 13 as electrode portions each having a stripe pattern having a width of 350 $\mu$m as shown in FIG. 1 were formed by a screen print method on both sides of the spacer main member 11 along the cut portions 14. The screen printing paste used was Ag paste having as its main components Ag and PbO. The thickness of the intermediate layer 13 was 8 $\mu$m.

Next, the spacer base member 11 was cut along the cut portions 14 with a dicing saw. A diamond cutter having a blade width of 30 $\mu$m was used, the cutting speed was set to 5 mm/sec, and the cut width was 50 $\mu$m.

In this embodiment, high resistance films and intermediate layers can be formed by using a large base material before it is cut into each spacer. Therefore, manufacture setting work efficiency was improved, a spacer forming time was shortened, and manufacture yield was improved.

With this embodiment, spacers were able to being formed easily and mass production ability was improved considerably.

(Second Embodiment)

Figure 2:
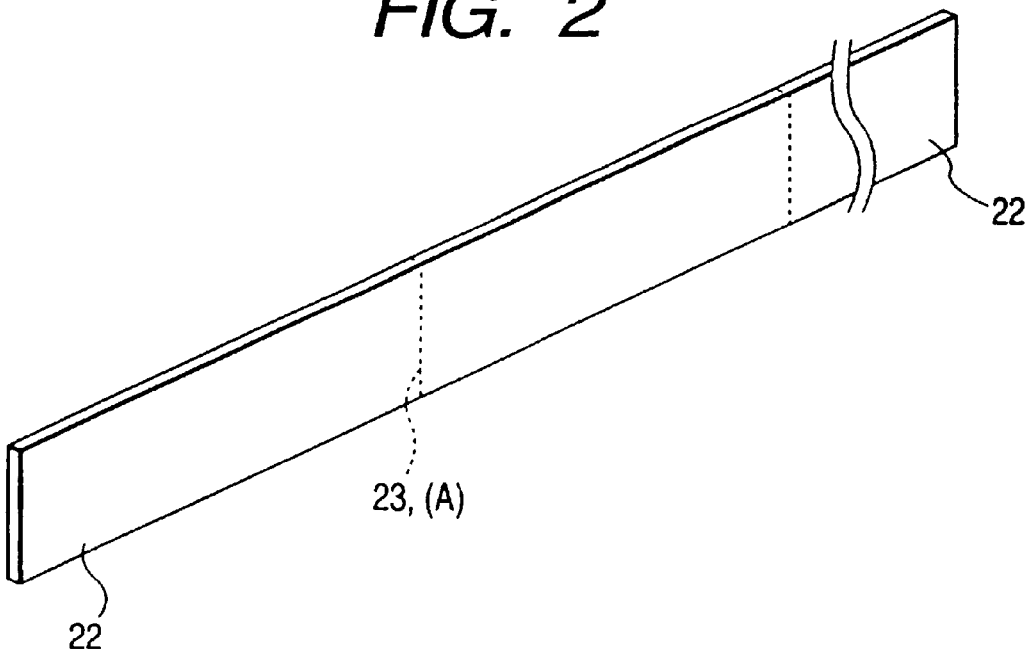
FIG. 2 is a perspective view showing another example of a spacer base member used for forming spacers.

The second embodiment will be described with reference to FIG. 2. In this embodiment, an elongate base member was used as a spacer base member. In FIG. 2, reference numeral 22 represents a spacer base member, and reference numeral 23 represents a cut portion. In this embodiment, the spacer base member 22 was formed through glass rod heating/drawing as in the following manner. A glass rod was heated into a state capable of shaping and deforming, and was then drawn. The formed spacer member 22 had a thickness of 0.3 mm and a length of about 500 mm. The width of the spacer base member 22 was 4 mm (which is equal to a distance between an electron source substrate and the metal back of the face plate of the display panel), and soda-lime glass was used.

Next, the spacer base member 22 was cut with a diamond cutter along the cut portions 23 through scribing, to form a plurality of spacers each having a length of 50 mm.

By using the spacers formed in the above manner, the display panel with spacers 1020 shown in FIG. 19 was formed. This method will be described in detail with reference to FIGS. 19 and 3. A substrate 1011 was fixed to a rear plate 1015, the substrate 1010 being already formed with row direction wiring electrodes 1013, column direction wiring electrodes 1014, insulating layers (not shown) between row and column direction wiring electrodes, and element electrodes and a conductive thin film of each surface conduction type emitting element. Next, the spacers 1020 formed in the manner described above were fixed to the row direction wiring electrodes 1013 of the substrate 1011 at an equal pitch.

Thereafter, a face plate 1017 having a fluorescent film 1018 and metal back 1019 on the inner side thereof was disposed on a side wall 1016, 5 mm above the substrate 1011. Connection areas of the rear plate 1015, face plate 1017, side wall 1016, and spacers 1020 were adhered. The connection area between the substrate 1011 and rear plate 1015, the connection area between the rear plate 1015 and side wall 1016, and the connection area between the face plate 1017 and side wall 1016 were hermetically adhered by coating frit glass (not shown) and baking it for 10 minutes or longer in an atmospheric air at 400 to 500° C.

Figure 3:
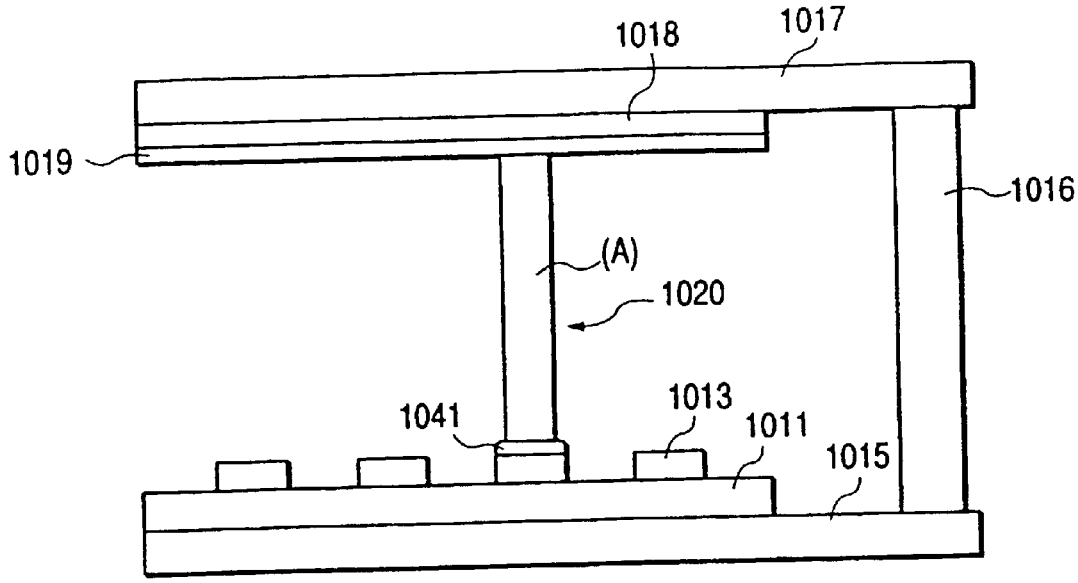
FIG. 3 is a diagram showing a spacer formed from the spacer base member shown in FIG. 2 and disposed in an image forming apparatus.

Each spacer 1020 was abutted upon the row direction wiring electrode 1013 (300 $\mu$m in width) on the substrate side 1011 and upon on the metal back 1019 on the face plate 1017 side, at non-cut portions other than a cut surface A formed by cutting the spacer base member 22. As shown in FIG. 3, in this embodiment, frit glass 1041 was disposed between the row direction wiring electrode 1013 and spacer 1020 and baked for 10 minutes or longer in an atmospheric air at 400 to 500° C.

Figure 34:
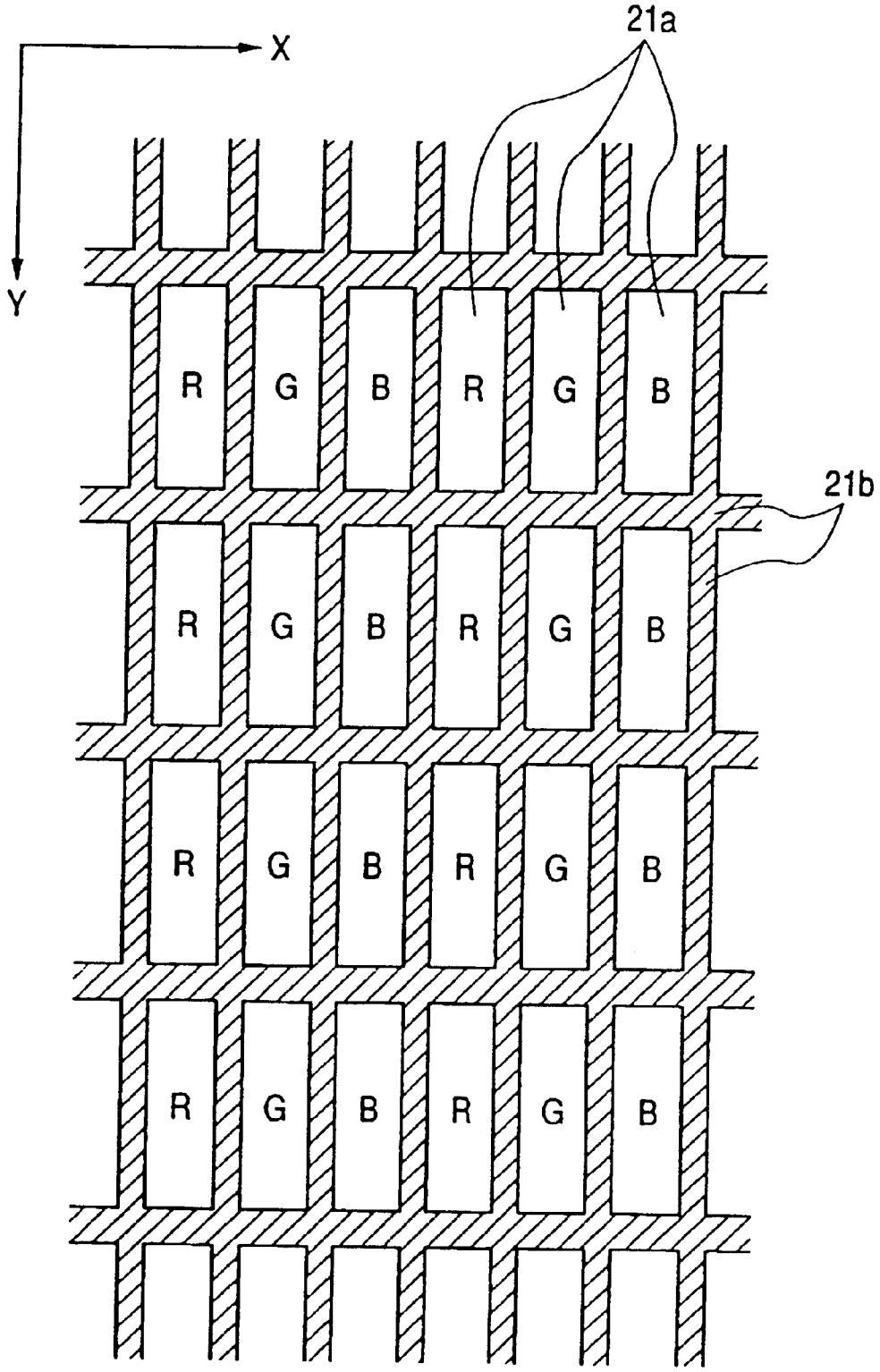
FIG. 34 is a diagram illustrating another example of the layout of fluorescent materials.

In this embodiment, as shown in FIG. 34, the fluorescent film 1018 having a stripe shape of each fluorescent material 21*a* extending in the column direction (Y direction) was used. The black color conductive material 21*b* was disposed between fluorescent materials 21*a* of respective colors (R, G, B) not only in the X direction but also in the Y direction. The spacer 1020 was disposed on the metal back 1019 in an area (300 $\mu$m in width) of the black color conductive material 21*b* along the row direction (X direction). In the hermetical sealing process, sufficient position alignment was performed between the rear plate 1015, face plate 1017 and spacers 1020 in order to match the fluorescent material of each color with each element on the substrate 1011.

The air-tight envelope completed in the above manner was evacuated by a vacuum pump via an exhaust pipe (not shown) to a sufficient vacuum degree. Thereafter, each element was electrically energized via the external terminals Dx1 to Dxm and Dy1 to Dyn and via the row and column direction wiring electrodes 1013 and 1014 to execute the electric energization forming and activation processes and complete a multi electron beam source.

Next, the unrepresented exhaust pipe was heated with a gas burner at the vacuum degree of about $10^{-6}$ Torr and melted to hermetically seal the air-tight envelope.

Lastly, a getter process was executed to maintain the vacuum degree after the hermetical sealing.

Figure 14:
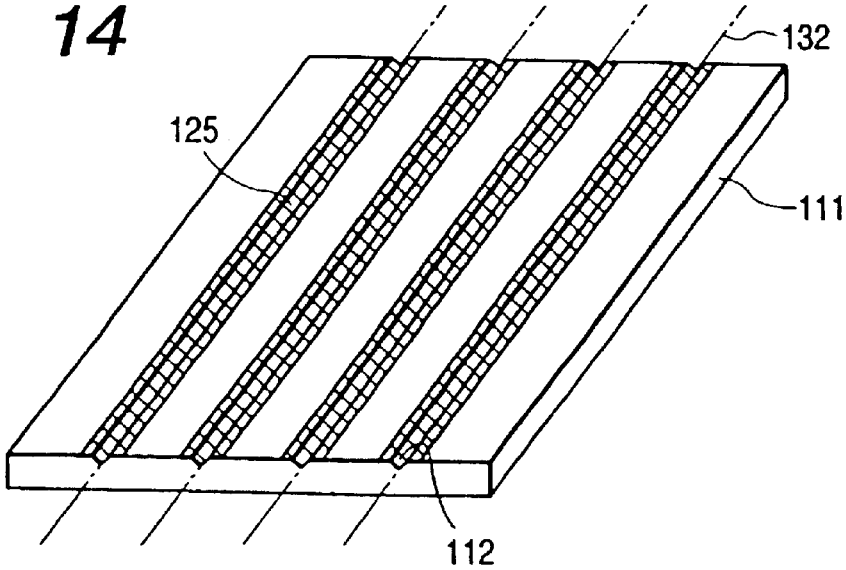
FIG. 14 is a perspective view showing still another example of a spacer base member used for forming spacers.

Scan signals and modulating signals from an unrepresented signal generator means were applied via the external terminals Dx1 to Dxm and Dy1 to Dyn to each cold cathode element (surface conduction type emitting element) 1012 of the image forming apparatus using the display panel shown in FIGS. 14 and 3 and completed in the above-described manner. A high voltage was also applied via the high voltage terminal Hv to the metal back 1019 to accelerate an emitted electron beam, make electrons collide with the fluorescent film 1018, excite the fluorescent material 21*a* of each color (R, G, B in FIG. 34), and emit light to form an image. The voltage Va applied to the high voltage terminal Hv was set to 3 to 10 Kv, and the voltage Vf applied across the wiring electrodes 1013 and 1014 was set to 14 V.

In this embodiment, a plurality of spacers are formed by using a large base member so that the work efficiency can be improved.

The image forming apparatus formed in this embodiment has a sufficient atmospheric pressure resistant structure. Even during the evacuation and sealing processes for the air-tight envelope, the spacers were not bent or broken and the sufficient space maintaining function as spacers was provided. A display image showed no distortion and the like.

In this embodiment, although the spacer 1012 is abutted upon the row direction wiring electrode 1013 by using the frit glass 1041, the frit glass 1041 may be used on the side of the metal back 1019 and the spacer 1012 is made in contact with the frit grass 1041 whereas the spacer 1012 is directly abutted upon the row direction wiring electrode 1013. Also in this case, the above-described advantages of the embodiment can be obtained.

(Third Embodiment)

Figure 4:
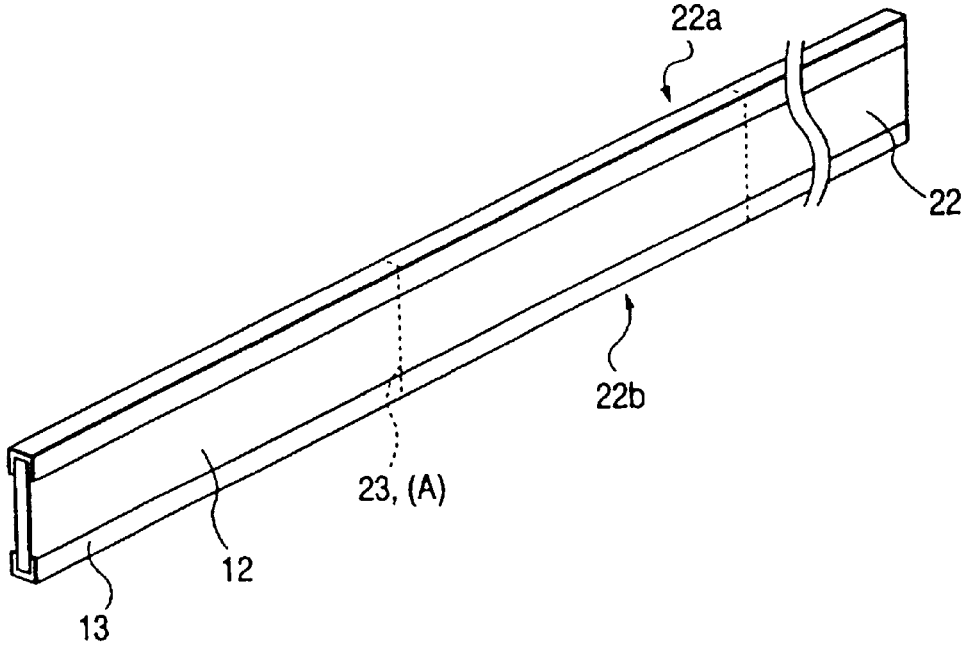
FIG. 4 is a perspective view showing still another example of a spacer base member used for forming spacers.

The third embodiment will be described with reference to FIG. 4. In this embodiment, an elongated base member was used as a spacer base member. In FIG. 4, reference numeral 22 represents a spacer base member, and reference numeral 23 represents a cut portion. Reference numeral 12 represents a high resistance film formed on both sides of the spacer base member 22, and reference numeral 13 represents an intermediate layer. In this embodiment, the spacer base member 22 was formed through glass rod heating/drawing as in the following manner. A glass rod was heated to change it in a semi-melted state. In this state, this glass rod was drawn from a slit. The formed spacer member 22 had a thickness of 0.3 mm and a length of about 500 mm. The width of the spacer base member 22 was 4 mm (which is equal to a distance between an electron source substrate and the metal back of the face plate of the display panel), and soda-lime glass was used.

Next, on both sides of the spacer base member 22, high resistance films 12 were formed in the following manner.

In place of the Ti target used in the first embodiment, a Cr target was used. On both sides of the spacer base member 22, a Cr—Al nitride film was formed to a thickness of 200 nm. Sputter gas same as the first embodiment was used. By adjusting the high frequency powers supplied to the Cr and Al targets, the nitride film was formed. On the surface of the Cr—Al nitride film, a chromium oxide film was continuously formed to a thickness of 5 nm by using the same system for the nitride film excepting that a mixture gas of Ar and oxygen was used as the sputtering gas. In this embodiment, the surface resistance value of the high resistance film 12 was $5\times10^{9}\Omega/\square$.

Next, the intermediate layers 13 were formed on the spacer base member 22 formed with the high resistance layers 12. The intermediate layers 13 as electrode portions were formed in the following manner. Portions 22*a* and 22*b* of the spacer were pressed against a paste layer formed by developing electrode paste on a substrate to a predetermined thickness, to transfer the electrode paste to the spacer base member 22. As the electrode paste, paste containing Ag and PbO as its main components was used. Each portion of the spacer base member 22 after the transfer of the electrode paste was preliminarily baked for 10 minutes at 120° C. to evaporate binder components. Thereafter, the spacer base member 22 was baked while it is maintained for 20 minutes at a highest temperature of 480° C. by using a belt furnace to form the intermediate layer. In this embodiment, the thickness of the electrode portion 13 was set to 8 $\mu$m.

Next, the spacer base member 22 was cut with a diamond cutter along the cut portions 23 through scribing, to form a plurality of spacers each having a length of 50 mm.

By using the spacers formed in the above manner, the display panel with spacers 1020 shown in FIG. 19 was formed. This method will be described in detail with reference to FIGS. 19 and 5. A substrate 1011 was fixed to a rear plate 1015, the substrate 1010 being already formed with row direction wiring electrodes 1013, column direction wiring electrodes 1014, insulating layers (not shown) between row and column direction wiring electrodes, and element electrodes and a conductive thin film of each surface conduction type emitting element. Next, the spacers 1020 formed in the manner described above were fixed to the row direction wiring electrodes 1013 of the substrate 1011 at an equal pitch.

Thereafter, a face plate 1017 having a fluorescent film 1018 and metal back 1019 on the inner side thereof was disposed on a side wall 1016, 5 mm above the substrate 1011. Connection areas of the rear plate 1015, face plate 1017, side wall 1016, and spacers 1020 were adhered. The connection area between the substrate 1011 and rear plate 1015, the connection area between the rear plate 1015 and side wall 1016, and the connection area between the face plate 1017 and side wall 1016 were hermetically adhered by coating frit glass (not shown) and baking it for 10 minutes or longer in an atmospheric air at 400 to 500° C.

Figure 5:
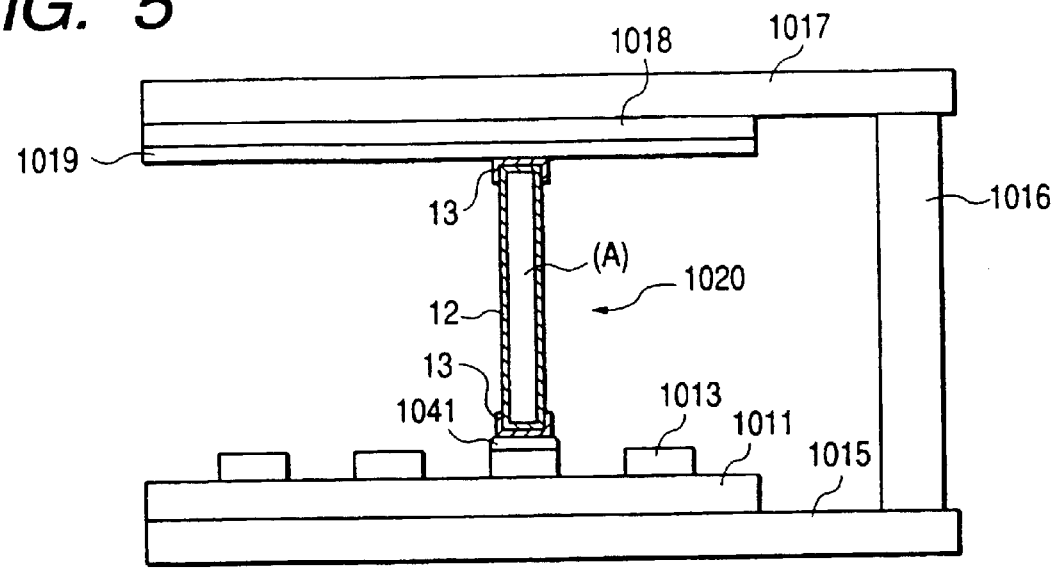
FIG. 5 is a diagram showing a spacer formed from the spacer base member shown in FIG. 4 and disposed in an image forming apparatus.

Each spacer 1020 was abutted upon the row direction wiring electrode 1013 (300 $\mu$m in width) on the substrate side 1011 and upon the metal back 1019 on the face plate 1017 side, at non-cut portions other than a cut surface A formed by cutting the spacer base member 22. As shown in FIG. 5, also in this embodiment, frit glass 1041 was disposed between the row direction wiring electrode 1013 and spacer 1020 and baked for 10 minutes or longer in an atmospheric air at 400 to 500° C.

In this embodiment, as shown in FIG. 34, the fluorescent film 1018 having a stripe shape of each fluorescent material 21*a* extending in the column direction (Y direction) was used. The black color conductive material 21*b* was disposed between fluorescent materials 21*a* of respective colors (R, G, B) not only in the X direction but also in the Y direction. The spacer 1020 was disposed on the metal back 1019 in an area (300 $\mu$m in width) of the black color conductive material 21*b* along the row direction (X direction). In the hermetical sealing process, sufficient position alignment was performed between the rear plate 1015, face plate 1017 and spacers 1020 in order to match the fluorescent material of each color with each element on the substrate 1011.

The air-tight envelope completed in the above manner was evacuated by a vacuum pump via an exhaust pipe (not shown) to a sufficient vacuum degree. Thereafter, each element was electrically energized via the external terminals Dx1 to Dxm and Dy1 to Dyn and via the row and column direction wiring electrodes 1013 and 1014 to execute the electric energization forming and activation processes and complete a multi electron beam source.

Next, the unrepresented exhaust pipe was heated with a gas burner at the vacuum degree of about $10^{-6}$ Torr and melted to hermetically seal the air-tight envelope.

Lastly, a getter process was executed to maintain the vacuum degree after the hermetical sealing.

Scan signals and modulating signals from an unrepresented signal generator means were applied via the external terminals Dx1 to Dxm and Dy1 to Dyn to each cold cathode element (surface conduction type emitting element) 1012 of the image forming apparatus using the display panel shown in FIGS. 19 and 5 and completed in the above-described manner. A high voltage was also applied via the high voltage terminal Hv to the metal back 1019 to accelerate an emitted electron beam, make electrons collide with the fluorescent film 1018, excite the fluorescent material 21*a* of each color (R, G, B in FIG. 34), and emit light to form an image. The voltage Va applied to the high voltage terminal Hv was set to 3 to 10 Kv, and the voltage Vf applied across the wiring electrodes 1013 and 1014 was set to 14 V. Light emission spots, including those formed by emission electrons from the cold cathode element 1012 near the spacer 1020, were formed at a two-dimensionally equal pitch, and an image with clear and good color reproductivity was able to be formed. This means that the intermediate layers 13 of the spacer 1020 were electrically connected in a good state to the metal bask 1019 and wiring electrodes 1013 so that even if the spacers 1020 were disposed as in this embodiment, disturbance of an electric field which affects the electron trajectory was not formed.

In this embodiment, high resistance films and intermediate layers can be formed by using a large base material before it is cut into each spacer. Therefore, manufacture setting work efficiency was improved, a spacer forming time was shortened, and manufacture yield was improved.

Furthermore, the image forming apparatus formed in this embodiment has a sufficient atmospheric pressure resistant structure. Even during the evacuation and sealing processes for the air-tight envelope, the spacers were not bent or broken and the sufficient space maintaining function as spacers was provided. A display image showed no distortion and the like.

In this embodiment, although the spacer 1012 is abutted upon the row direction wiring electrode 1013 by using the frit glass 1041 as shown in FIG. 5, the frit glass 1041 may be used on the side of the metal back 1019 and the spacer 1012 is made in contact with the frit grass 1041 whereas the spacer 1012 is directly abutted upon the row direction wiring electrode 1013. Also in this case, the above-described advantages of the embodiment can be obtained.

Also in this embodiment, as described above, solution which contains conductive substances such as Ag-containing paste is developed on a substrate. An end portion of the spacer is immersed in this solution to transfer the solution to the spacer base member. After this transfer, the spacer base material is heated to form the intermediate layer. Not only in this embodiment, but also in other embodiments, such an intermediate layer forming method is effective in that the intermediate layer is hard to be peeled off at the boundary between the bottom and side surface of the spacer base member, i.e., at the edge of the spacer base member.

Further, according to the present embodiment, the base member formed by the heating/drawing is further subjected to the above transfer and heating, thereby forming the intermediate layer. While, without being limited the above embodiment, another method for forming the intermediate layer by means of a combination of the transfer and the heating/drawing may be further advantageous method in the following reason, that is, in general, the base member produced by the heating/drawing has edge sections with curved surface at upper and lower contact sections of the spacer due to the heating process. Accordingly, in case of using the above transfer in forming the intermediate layer, since the transfer liquid is transferred uniformly to the base member desirably rather than the base member of which sectional shape has a right angled corner, the intermediate layer can be formed more precisely. Also, simultaneously, the spacer can be supplied in a good yielding ratio.

(Forth Embodiment)

In this embodiment, connection portions are partially formed in the spacer in order to establish reliable electric connection of the upper and lower intermediate layers. This embodiment is particularly effective for an image forming apparatus having a small pixel size. This embodiment can reduce defective connections which are formed at a spacer cut portion on rare occasions such as when the amount of conductive frit for spacer connection is reduced and when the spacer is electrically connected only by physical contact without using conductive frit, in order to form a high precision display apparatus. The defective and normal connections will be described with reference to FIGS. 6 and 7.

Figure 6:
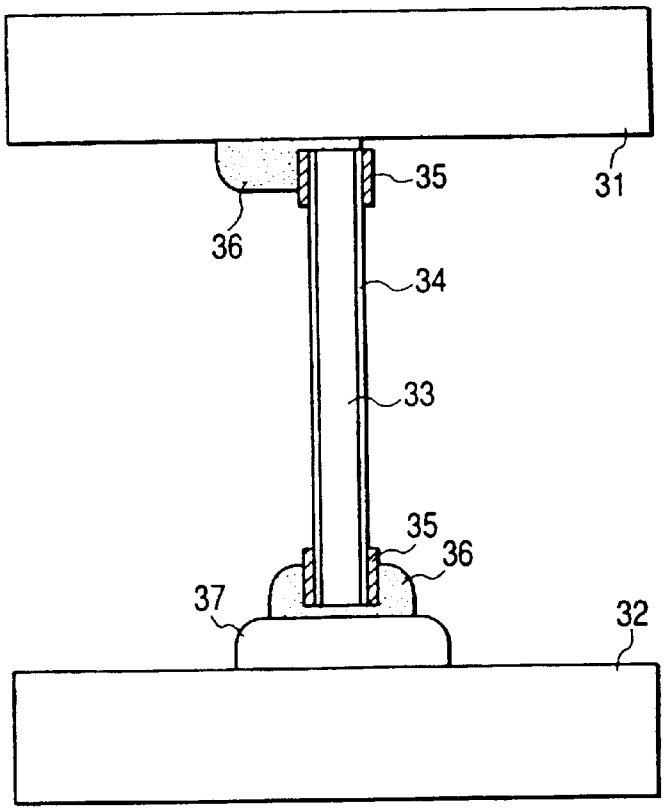
FIG. 6 is a diagram illustrating a defective connection state of a spacer in an image forming apparatus.
Figure 7:
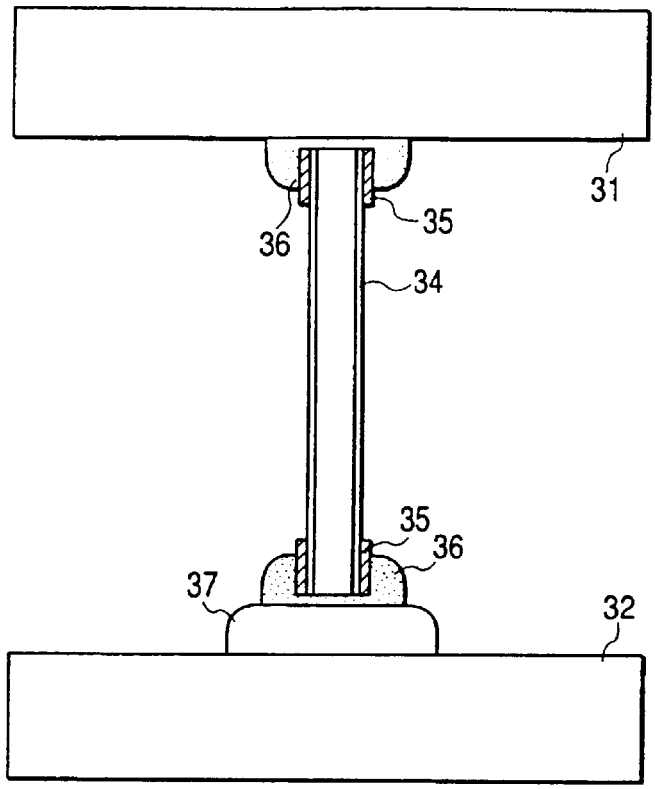
FIG. 7 is a diagram illustrating a normal connection state of a spacer in an image forming apparatus.
Figure 8:
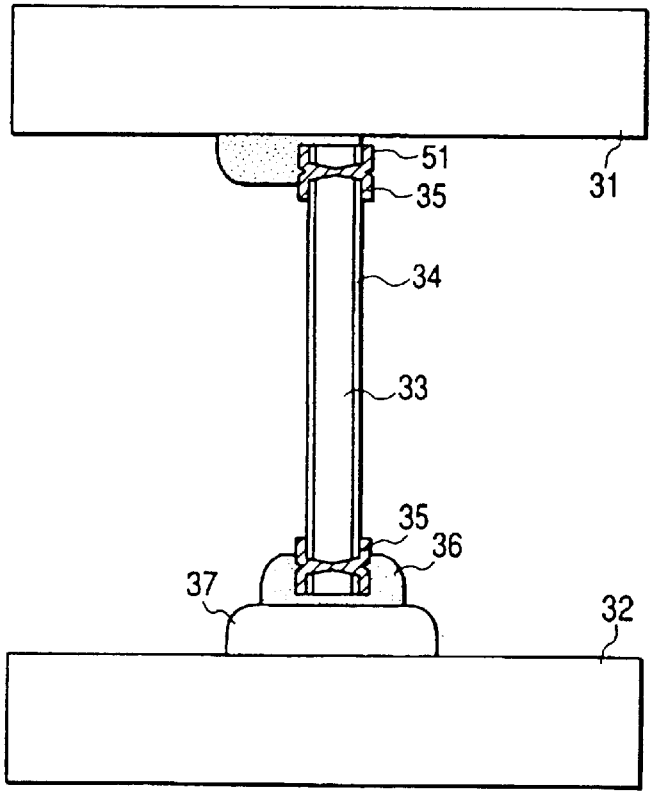
FIG. 8 is a diagram showing a spacer having contact holes and disposed in an image forming apparatus.

FIG. 6 shows a defective connection which occurs on rare occasions, and FIG. 7 shows a normal connection. In FIGS. 6 and 7, reference numerals 31 represents a face plate substrate, reference numeral 32 represents an electron source substrate, reference numeral 33 represents a spacer substrate, reference numeral 34 represents an intermediate layer, reference numeral 36 represents a conductive connection area, and reference numeral 37 represents a wiring electrode on the electron source substrate. In FIG. 6, the intermediate layer on one side is not connected to the conductive connection area. FIG. 8 shows a spacer according to the fourth embodiment, the spacer having contact holes 51.

Next, a method of forming a spacer with contact holes will be described with reference to FIG. 9.

Figure 9:
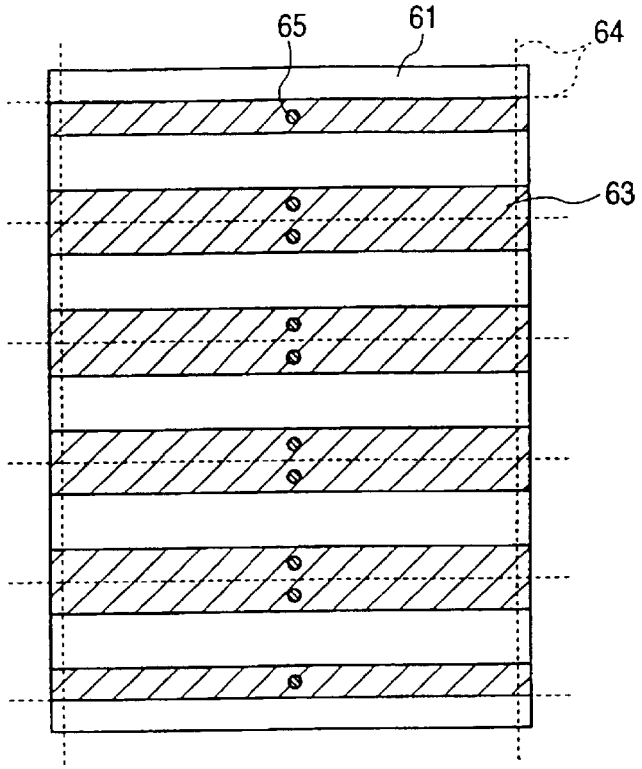
FIG. 9 is a diagram showing an example of a spacer base member used for forming the spacer shown in FIG. 8.

FIG. 9 shows a spacer base member made of alumina and formed with intermediate layers and high resistance films. In FIG. 9, reference numeral 61 represents a spacer base member, reference numeral 63 represents an intermediate layer, reference numeral 64 represents a cut portion, and reference numeral 65 represents a contact hole.

First, the spacer base member 61 was formed by baking a green sheet containing alumina as its main components and formed with a doctor blade. In this embodiment, the spacer base member 61 used was 300 mm×100 mm square and 0.2 mm in thickness.

Next, on both sides of the spacer base member 61, high resistance films were formed in the following manner. In place of the Ti target used in the first embodiment, a Ta target was used. A Ta—Al nitride film was formed on both sides of the spacer base member 61 to a thickness of 80 nm. Sputter gas same as the first embodiment was used. By adjusting the high frequency powers supplied to the Ta and Al targets, the nitride film was formed. On the surface of the Ta—Al nitride film, an amorphous carbon film was formed by plasma CVD to a thickness of 3 nm to complete the high resistance film.

In this embodiment, the surface resistance value of the high resistance film was $1\times10^{10}\Omega/\square$.

Next, contact holes were formed at predetermined positions of the spacer base material 61 formed with the high resistance film. A method of forming a contact hole will be described with reference to FIGS. 10A and 10B.

Figure 10A:
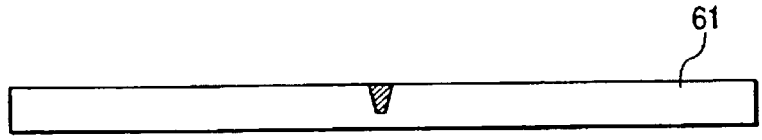
FIGS. 10A, 10B, 10C and 10D are diagrams illustrating a method of forming the spacer shown in FIG. 8.
Figure 10B:
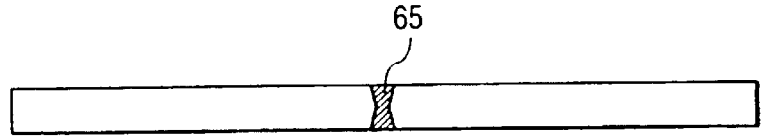
Figure 10C:
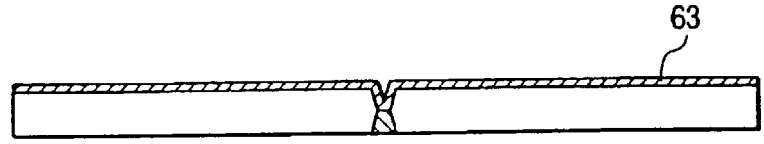
Figure 10D:
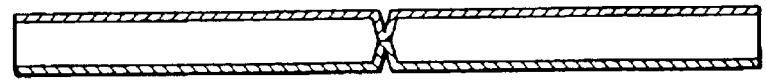

As shown in FIGS. 10A and 10B, a partial area of the spacer base member where a contact hole is formed was removed from both sides of the member by using YAG laser. The contact hole 65 is preferably of a conical shape. The shape is not, however, limited only thereto. Next, as shown in FIGS. 10C and 10B an intermediate layer 63 of Al is deposited on both sides of the spacer base member to a thickness of 300 nm to form the spacer base member shown in FIG. 9.

In this embodiment, although a partial area of the space base member is removed from both sides thereof by using laser, it may be removed from one side thereof.

Next, the spacer base member 61 was cut along the cut portions 64 with a dicing saw, similar to the first embodiment, to form spacer members each having a size of 20 mm×4 mm.

Next, the cut spacer member was cut with a diamond cutter through scribing to form a plurality of spacers each having a length of 50 mm.

Also in this embodiment, high resistance films and intermediate layers can be formed by using a large base material before it is cut into each spacer. Therefore, manufacture setting work efficiency was improved, a spacer forming time was shortened, and manufacture yield was improved. With this embodiment, even if one intermediate layer is not directly connected to the conductive connection area, it can be electrically connected via the contact hole. The manufacture yield was improved further without damaging the spacer function.

(Fifth Embodiment)

In this embodiment, grooves are partially formed in the spacer base member in order to establish reliable electric connection of the upper and lower intermediate layers. This embodiment is particularly effective for an image forming apparatus having a small pixel size, similar to the fourth embodiment. This embodiment will be described with reference to FIGS. 11 to 13.

Figure 11:
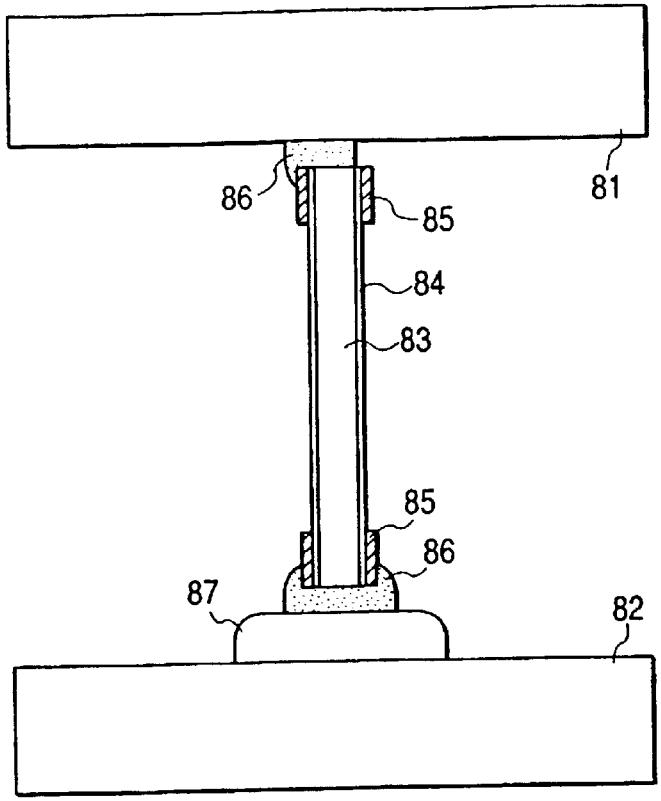
FIG. 11 is a diagram illustrating another example of a defective connection state of a spacer in an image forming apparatus.
Figure 12:
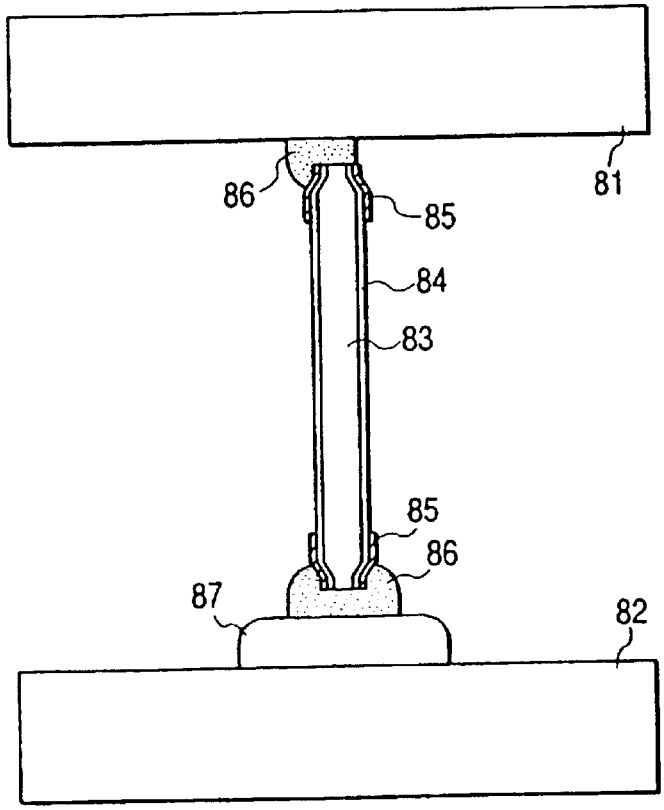
FIG. 12 is a diagram illustrating another example of a normal connection state of a spacer in an image forming apparatus.
Figure 13:
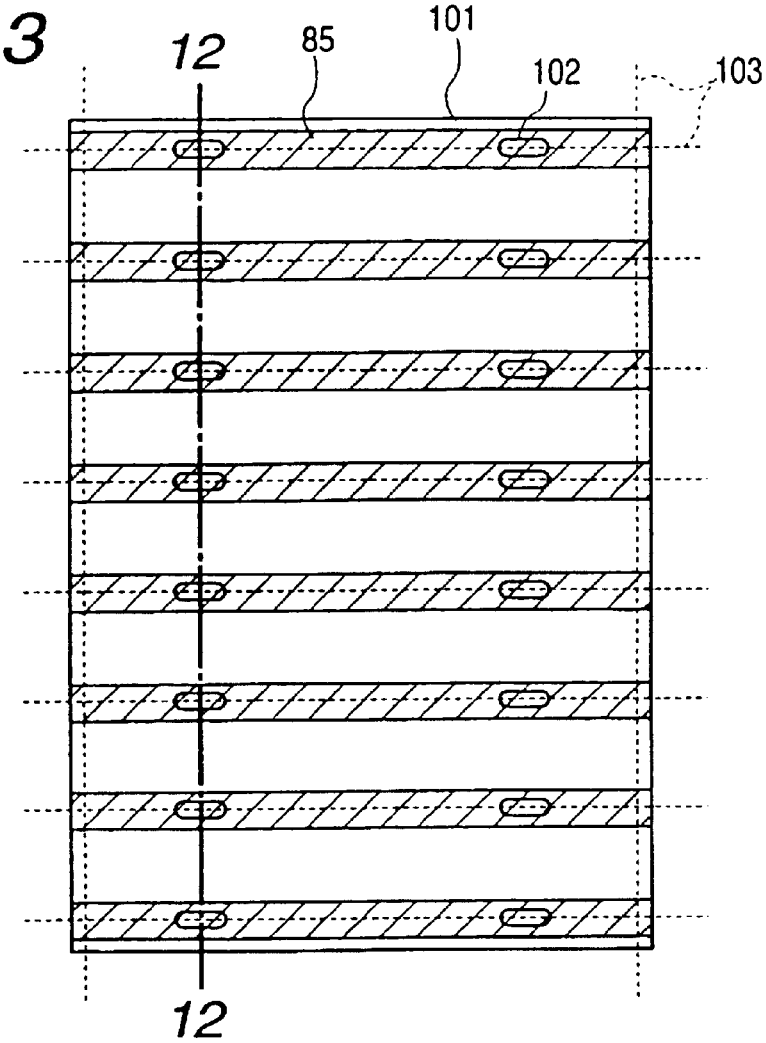
FIG. 13 is a diagram showing an example of a spacer base member used for forming the spacer shown in FIG. 12.

FIG. 11 shows a defective connection. In FIG. 11, reference numerals 81 represents a face plate substrate, reference numeral 82 represents an electron source substrate, reference numeral 83 represents a spacer substrate, reference numeral 84 represents a high resistance film, reference numeral 85 represents an intermediate layer, reference numeral 86 represents a conductive connection area, and reference numeral 87 represents a wiring electrode on the electron source substrate. In FIG. 11, one intermediate layer on the side of the face plate substrate 81 is not connected to the conductive connection area. FIGS. 12 and 13 illustrate the fifth embodiment. In FIGS. 12 and 13, reference numeral 101 represents a spacer substrate, reference numeral 102 represents a groove, and reference numeral 103 represents a cut portion. The spacer shown in FIG. 12 corresponds to the cross section taken along line 12—12 of the spacer base member shown in FIG. 13.

As shown in FIG. 13, the groove 102 is formed in a partial area of the spacer base member 101. Therefore, a taper portion is formed in the spacer base member to improve the connection between the intermediate layer 85 and conductive connection area 86 as shown in FIG. 9. Also in this embodiment, defective connections to be formed at the base cut portion in rare occasions can be reduced.

The spacer of this embodiment was formed in the following manner. The spacer base member 101 shown in FIG. 13 was formed by molding an alumina member with a metal mold having projections corresponding to the grooves 102 and thereafter by baking the alumina member. In this embodiment, the size of the spacer base member was 55 mm×70 mm, the thickness was 0.3 mm, and the depth of the groove was 50 $\mu$m. The groove 102 was formed on both sides of the spacer base member 101 along the cut portion 103. With similar methods to those of the first embodiment, the high resistance film and intermediate layer 85 were formed sequentially. Thereafter, similar to the first embodiment, the spacer base member 101 was cut with a dicing saw along the cut portion 103 to form a plurality of spacers each having a size of 50 mm×6 mm.

Also in this embodiment, high resistance films and intermediate layers can be formed by using a large base material before it is cut into each spacer. Therefore, manufacture setting work efficiency was improved, a spacer forming time was shortened, and manufacture yield was improved. With this embodiment, connection between the intermediate layer 85 and conductive connection area 86 can be established at the groove as described with reference to FIG. 12. Therefore, defective connections are hard to be formed and the manufacture yield can be improved further.

Spacers of this embodiment were used with an image forming apparatus similar to that used with the second and third embodiments. However, in this embodiment, the abut surfaces of the spacer upon the face plate substrate 81 and electron source substrate 82 were the cut surfaces. The image forming apparatus of this embodiment has a sufficient atmospheric pressure resistant structure and a sufficient space maintaining function of the spacer. A good color image can be displayed which means good electrical connections at both the metal back of the face plate and the wiring electrode of the electron source substrate.

In this embodiment, the tapered portion formed by the projection of the metal mold is formed partially in the spacer. The tapered portion may be formed over the whole length of the spacer, with similar expected advantages. The taper portion may be formed either on the side of the face plate or on the side of the electron source substrate.

In this embodiment, although the groove is formed by the metal mold, the groove may be formed by a sand blaster method by which abrasive is blown toward the spacer base member to partially remove the spacer base member, or by a method by which the spacer base member is partially removed by laser.

(Sixth Embodiment)

This embodiment features in that a cut groove is formed in the spacer base member in advance. This embodiment will be described with reference to FIG. 14 which shows a spacer base member of this embodiment. In FIG. 14, reference numeral 111 represents a spacer base member, reference numeral 112 represents a tapered groove, reference numeral 132 represents a cut portion, and reference numeral 125 represents an intermediate layer.

In this embodiment, first, a spacer base member 111 is formed by a sheet forming method. In this case, a doctor blade having triangular projections was used to form a plurality of tapered grooves along one direction of the spacer base member 111. The size of the spacer base member was 80 mm square, the thickness thereof was 0.2 mm, the depth of the groove was 50 $\mu$m, and the groove width was about 50 $\mu$m.

Next, a high resistance film was formed on both sides of the spacer base member 111, and as shown in FIG. 14, the intermediate layer 125 was formed in each groove 112. Thereafter, the spacer base member 112 was cut off by applying a force thereto along the cut portion 132 to form a plurality of spacers.

Figure 15:
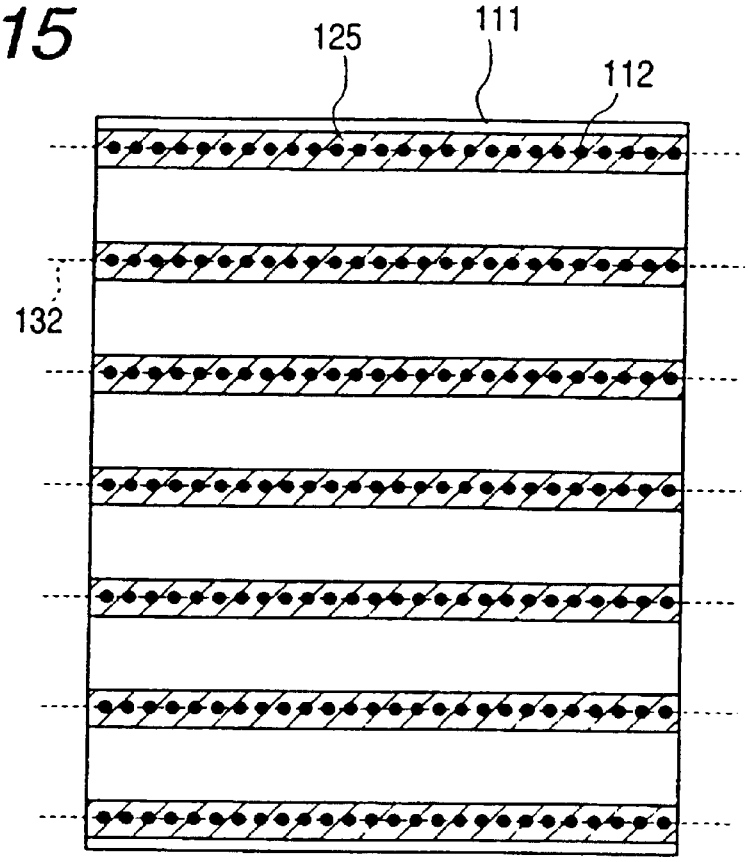
FIG. 15 is a diagram showing still another example of a spacer base member used for forming spacers.

In this embodiment, the groove for cutting off the space base member is formed by using the doctor blade. Instead, as shown in FIG. 15, a plurality of through holes or via holes may be formed along the cut portion by using carbondioxide gas laser to cut off the spacer base member.

Figure 16:
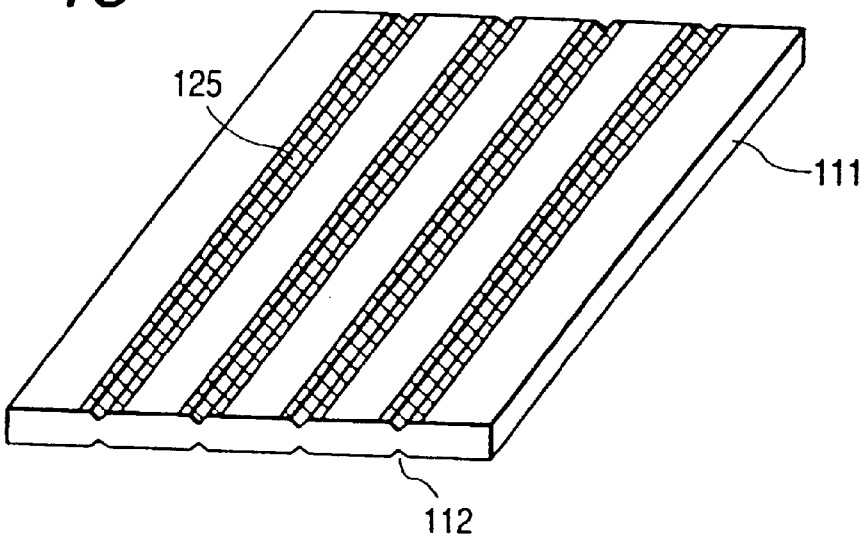
FIG. 16 is a perspective view showing still another example of a spacer base member used for forming spacers.

The groove may be formed on both sides of the spacer base member instead of one side, as shown in FIG. 16.

Spacers of this embodiment were used with an image forming apparatus similar to that used with the second and third embodiments. However, in this embodiment, the abut surfaces of the spacer upon the face plate substrate 81 and electron source substrate 82 were the cut surfaces. The image forming apparatus of this embodiment has a sufficient atmospheric pressure resistant structure and a sufficient space maintaining function. A good color image can be displayed which means good electrical connections at both the metal bask of the face plate and the wiring electrode of the electron source substrate.

In this embodiment, the tapered groove for cutting off the spacer base member provides the reliable electrical connection between the upper and lower intermediate layers and conductive connection areas.

(Seventh Embodiment)

As another embodiment, the case wherein the first embodiment method is applied to the structure having an intermediate layer only on one side of the spacer, will be described.

Figure 17:
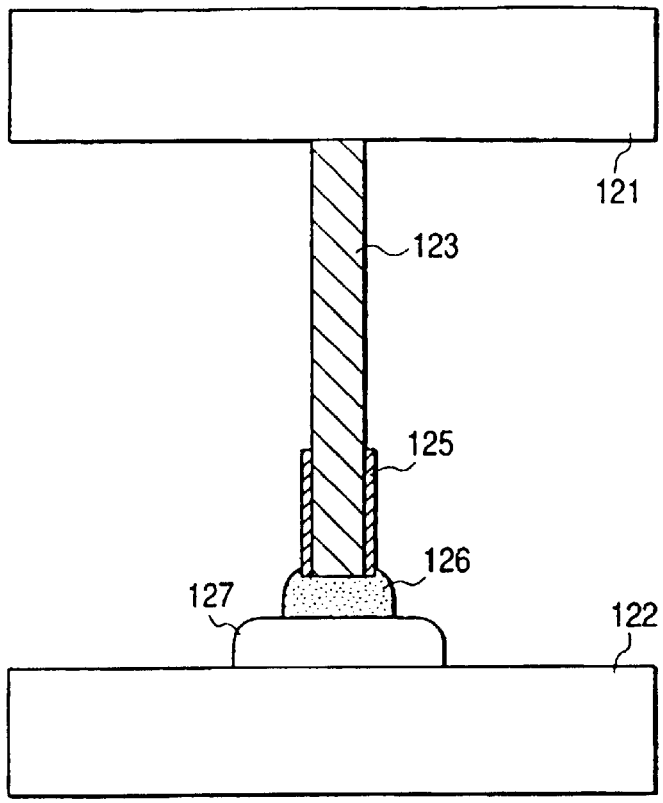
FIG. 17 is a diagram showing another example of a spacer disposed in an image forming apparatus.

FIG. 17 shows the structure of this embodiment. In FIG. 17, reference numeral 121 represents a face plate substrate, reference numeral 122 represents an electron source substrate, reference numeral 123 represents a spacer, reference numeral 125 represents an intermediate layer, reference numeral 126 represents a conductive connection area, and a reference numeral 127 represents a wiring electrode on the electron source substrate. Referring to FIG. 17, the intermediate layer 125 is formed on only one side of the spacer base member. The intermediate layer 125 is electrically connected to the wiring electrode 127 on the electron source substrate via the conductive connection area 126. The spacer 123 is maintained fixed by the conductive connection area 126 on the side of the electron source substrate 122.

Figure 18:
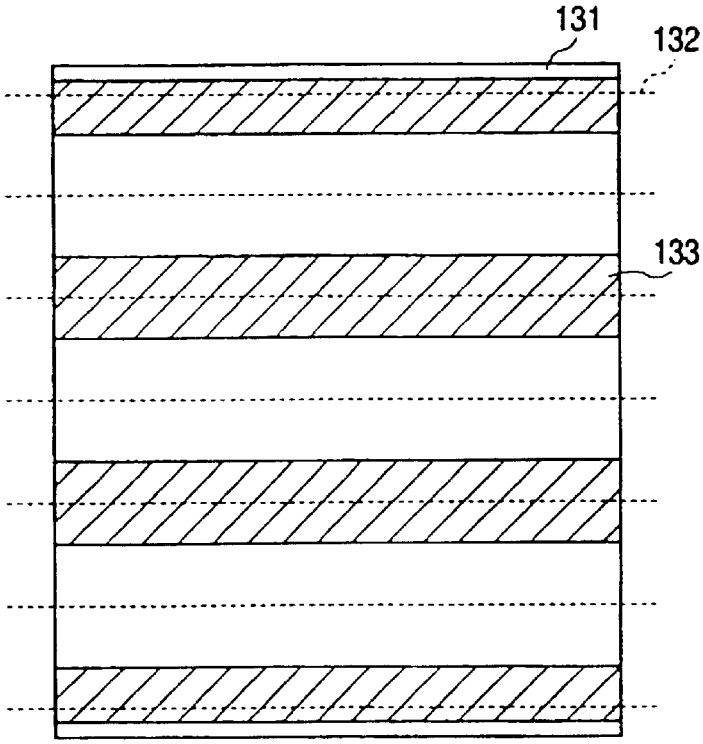
FIG. 18 is a diagram showing an example of a spacer base member used for forming the spacer shown in FIG. 17.

FIG. 18 shows the spacer base member of this embodiment. In FIG. 18, reference numeral 13 represents a spacer base member, and reference numeral 132 represents a line along which the groove 112 shown in FIG. 16 is formed, this line corresponding to the cut portion for the spacer base member. Reference numeral 133 represents an intermediate layer.

Also with this structure, similar advantages described earlier can be obtained.

The invention is also applicable to cold cathode electron emission elements different from surface conduction type emitting elements. For example, the invention is applicable to a field effect emission type element having a pair of electrodes formed in parallel with a substrate surface of an electron source, as described in JP-A-63-274047 assigned to the same assignee as the present assignee.

The invention is also applicable to am image forming apparatus using an electron source of the type different from a simple matrix form. For example, the spacer or space maintaining member such as described above is used between an electron source and a control electrode of an image forming apparatus which selects each surface conduction type emitting element by using the control electrode, as described in JP-A-2-257551.

According to the concept of this invention, the invention is applied not only to an image forming apparatus suitable for image display but also to an image forming apparatus which is used for the light emission source such as light emitting elements of an optical printer constituted of a photosensitive drum and the light emitting diodes. In the latter case, by properly selecting M×N row and column direction wiring electrodes, the image forming apparatus can be used not only as a line light emission source but also as a two-dimensional light emission source.

According to the concept of this invention, the invention is also applicable to the case wherein a member to which electrons are radiated from an electron source is a member other than an image forming member, e.g., an electron microscope. Therefore, the image forming apparatus of this invention may be used as an electron beam generator which does not limit a member to which electrons are radiated.

Figure 35:
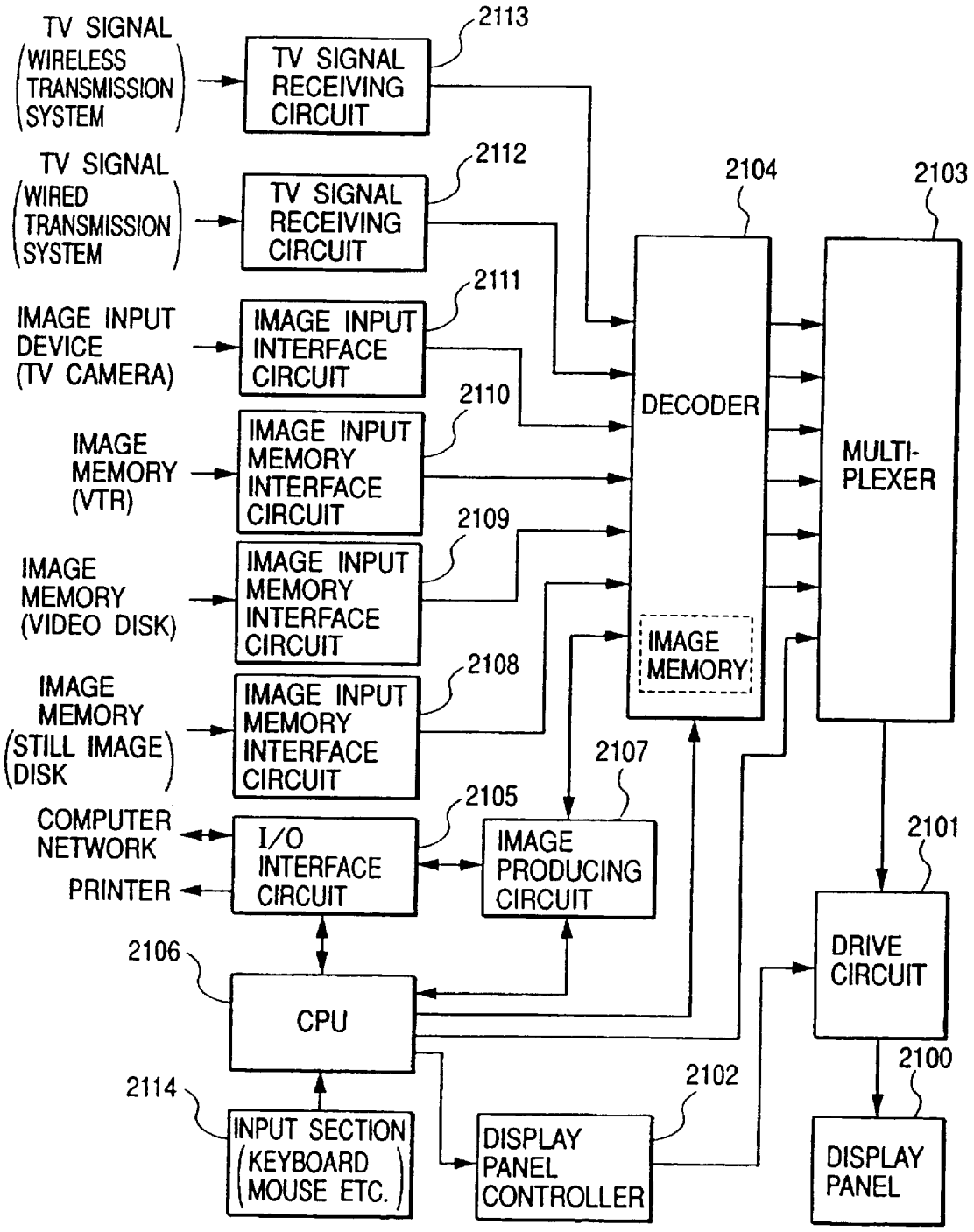
FIG. 35 is a block diagram of a multi function image display apparatus.

FIG. 35 is a block diagram showing an example of a multi function display apparatus capable of displaying image information supplied from various image information sources such as television broadcasting, on a display panel using surface conduction type emitting elements described above as an electron beam source.

In FIG. 35, reference numeral 2100 represents a display panel, reference numeral 2101 represents a drive circuit for driving the display panel, reference numeral 2102 represents a display controller, reference numeral 2103 represents a multiplexer, reference numeral 2104 represents a decoder, reference numeral 2105 represents an input/output interface circuit, reference numeral 2106 represents a CPU, reference numeral 2107 represents an image producing circuit, reference numerals 2108, 2109 and 2100 represent an image memory interface circuit, reference numeral 2111 represents an image input interface circuit, reference numerals 2112 and 2113 represent a TV signal receiving circuit, and reference numeral 2114 represents an input section.

If this display apparatus receives a signal containing both visual information and audio information, such as a television signal, it is obvious that both visual and audio information are reproduced at the same time. The description of circuits used for reception, separation, reproduction, processing, storage and the like of audio information and a speaker are omitted.

The function of each component will be described in the order of an image signal flow.

The TV signal receiving circuit 2113 is a circuit for receiving a TV image signal transmitted via a wireless transmission system such as radio wave communications and optical communications. The type of a TV signal to be received is not limited. For example, various TV signals may be used such as NTSC signals, PAL signals, and SECAM signals. TV signals having scan lines larger than NTSC, PAL and SECAM (such as high definition TV signals including MUSE signals) may also be used which are suitable for positively utilizing the advantages-of the display panel suitable for a large display screen and a large number of pixels. A TV signal received at the TV signal receiving circuit 2113 is supplied to the decoder 2104.

The TV signal receiving circuit 2112 is a circuit for receiving a TV image signal transmitted via a wired transmission system such as coaxial cables and optical fibers. Similar to the TV signal receiving circuit 2113, the type of TV signal is not limited to a particular type, and the TV signal received by this circuit 2112 is also supplied to the decoder 2104.

The image input interface circuit 2111 is a circuit for fetching an image signal supplied from an image input device such as a TV camera and an image scanner. The fetched image signal is supplied to the decoder 2104.

The image memory interface circuit 2110 is a circuit for fetching an image signal stored in a video tape recorder (hereinafter abbreviated as VTR). The fetched image signal is supplied to the decoder 2104.

The image memory interface circuit 2109 is a circuit for fetching an image signal stored in a video disk. The fetched image signal is supplied to the decoder 2104.

The image memory interface circuit 2108 is a circuit for fetching an image signal stored in a device storing still image data such as a so-called still image disk. The fetched image signal is supplied to the decoder 2104.

The input/output interface circuit 2105 is a circuit for connecting the display apparatus to an external computer, a computer network, or an output device such as a printer. The input/output interface circuit 2105 usually transfers image data and character/graphics data, and in some cases transfers control signals and numerical data between CPU 2106 of the display apparatus and an external circuit.

The image producing circuit 2107 generates display image data in accordance with image data and character/graphics data externally input from the input/output interface circuit 2105 and image data and character/graphics data output from CPU 2106. This image producing circuit 2207 is assembled with circuits necessary for image production, such as a rewritable memory for storing image data and character/graphics data, a ROM for storing image patterns corresponding to character codes, and a processor for image processing.

Display image data generated by this image producing circuit 2107 is supplied to the decoder 2104. In some cases, the display image data may be supplied via the input/output interface circuit 2105 to an external computer network and a printer.

CPU 2106 mainly performs an operation control of the display apparatus, generation, selection and edition of display images.

For example, CPU 2106 outputs a control signal to the multiplexer 2103 to select or combine image signals to be displayed on the display panel. In this case, CPU 2106 supplies a control signal to the display panel controller 2102 in accordance with an image signal to be displayed, to thereby control the operation of the display panel regarding a screen display frequency, a scan method (such as interlace or non-interlace), and the number of scan lines of one field.

CPU 2106 also controls to directly output image data and character/graphics data to the image producing circuit 2107, and to access via the input/output interface circuit 2105 to fetch image data and character/graphics data. CPU 210 may also help other tasks. For example, CPU 210 may directly operate to use the function of generating and processing data, similar to a personal computer and a word processor.

Alternatively, CPU 210 may connect an external computer network via the input/output interface circuit 2105 to perform a task, for example, arithmetic calculation, together with an external apparatus.

The input section 2114 is used for an operator to enter a command, a program, or data to CPU 2106. The input section 2114 may use various input devices such as a keyboard, a mouse, a joy stick, a bar code reader, and a voice-recognition device.

The decoder 2104 decodes various image signals input from the circuits 2107 to 2113 into three primary colors, or a combination of a luminance signal, an I signal and a Q signal. It is preferable that the decoder 2104 has therein an image memory indicated by a broken line in FIG. 35. This is because it is necessary to process TV signals such as MUSE signals which require an image memory when these signals are decoded. In addition, provision of the image memory facilitates a display of a still image. Alternatively, it becomes easy to perform image processing such as image thinning, interpolation, enlargement, reduction, and synthesis, in addition to image edition, in cooperation with the image production circuit 2107 and CPU 2106.

The multiplexer 2103 selects desired images in accordance with a control signal supplied from CPU 2106. Namely, the multiplexer 2103 selects desired image signals from the decoded image signals input from the decoder 2104 and outputs the selected image signals to the drive circuit 2101. In this case, if selected image signals are changed during one frame display time, different images can be displayed in divided areas of the screen, similar to a so-called multi screen television.

The display panel controller 2101 controls the operation of the drive circuit 2101 in accordance with a control signal supplied from CPU 2106.

The display panel controller 2101 also supplies the drive circuit 2101 with a signal for controlling the fundamental operation of the display panel, for example, the operation sequence of a drive power source (not shown) of the display panel.

The display panel controller 2101 also supplies the drive circuit 2101 with a signal for controlling the drive operation of the display panel, for example, a screen display frequency and a scan method (interlace or non-interlace).

In some cases, the display panel controller 2101 also supplies the drive circuit 2101 with a signal for controlling the image quality, for example, a display image luminance and contrast, color tone, and sharpness.

The drive circuit 2101 generates a drive signal to be applied to the display panel 2100, and operates in accordance with the image signal input from the multiplexer 2103 and a control signal input from the display panel controller 2102.

The function of each component has been described above. With the display apparatus constructed as shown in FIG. 35, image information input from various image information sources can be displayed on the display panel 2100.

More specifically, after various image signals including television signals are decoded by the decoder 2104, desired image signals are selected by the multiplexer 2103 and input to the drive circuit 2101. In the meantime, the display controller 2102 generates a control signal for controlling the operation of the drive circuit 2101, in accordance with the image signals to be displayed. The drive circuit 2101 applies drive signals to the display panel in accordance with the image signals and control signal.

In this manner, an image is displayed on the display panel. A series of these operations is controlled collectively by CPU 2106.

With a cooperative operation by the image memory in the decoder 2104, image producing circuit 2107 and CPU 2100, the display apparatus can display image information selected from a plurality piece of image information, and also perform other operations such as image processing and image editing. The image processing includes image enlargement, reduction, rotation, motion, edge emphasis, thinning, interpolation, color conversion and image aspect conversion. The image editing includes image synthesis, erase, coupling, replacement and superposition. Although not particularly described in this embodiment, a dedicated circuit for audio processing and editing may be used similar to image processing and editing.

The display apparatus can therefore provide singularly all functions of a television display apparatus, a television conference terminal equipment, a business terminal equipment such as a word processor, and a game machine. The application range of this display apparatus is very broad covering both industrial and commercial application fields.

FIG. 35 shows only illustratively an example of the structure of the display apparatus using a display panel with an electron beam source made of surface conduction type emitting elements. Obviously, the invention is not limited only thereto. For example, of the constituent elements shown in FIG. 35, circuits providing the functions not necessary for the specific application field may be omitted. Conversely, constituent elements may be added in accordance with a specific application field. For example, if this display apparatus is to be used as a video telephone, proper constituent elements are added, such as a television camera, a microphone, an illuminator, a transceiver including a modem.

The display panel of this display apparatus, particularly the display panel using surface conduction type emitting elements as an electron beam source, can be made compact and thin. Therefore, the depth of the display apparatus can be made shallow. Moreover, the display panel using surface conduction type emitting elements is easy to have a large screen area, a high luminance, and excellent characteristics of field of view. It is therefore possible for the display apparatus to display an image rich in scene appearance and excitements with good visualization.

(Advantages of the Invention)

According to the present invention, it is possible to provide an image forming apparatus provided with spacers having an improved space maintaining function.

According to the present invention, it is possible to provide an image forming apparatus capable of further reducing a displacement of an electron trajectory to be caused by a spacer.

According to the present invention, it is possible to provide an image forming apparatus capable of displaying a high quality image.

According to the invention, it is possible to provide a method of manufacturing an image forming apparatus capable of forming spacers with improved work efficiency and yield.

What is claimed is:

1. A method of manufacturing an image forming apparatus, having an envelope made of members inclusive of a first substrate and a second substrate disposed at a space being set therebetween, image forming means and spacers disposed in the envelope, the spacers maintaining the space, the method comprising the steps of:

forming a groove in a spacer base member and cutting the spacer base member along the groove to form a spacer having a desired shape; and abutting the spacer upon the first substrate or second substrate at cut surface of the spacer, wherein said step of forming a spacer having a desired shape includes a step of forming a conductive film on the groove of the spacer base member, and a step of cutting the spacer base member along the groove to form the spacer having the desired shape.

2. A method of manufacturing an image forming apparatus, having an envelope made of members inclusive of a first substrate and a second substrate disposed at a space being set therebetween, image forming means and spacers disposed in the envelope, the spacers maintaining the space, the method comprising the steps of:

forming a groove in a spacer base member and cutting the spacer base member along the groove to form a spacer having a desired shape; and abutting the spacer upon the first substrate or second substrate at cut surface of the spacer, wherein said step of forming a spacer having a desired shape includes a step of forming a conductive film on surfaces of the spacer base member formed with the groove, and a step of cutting the spacer base member along the groove to form the spacer having the desired shape.

3. A method of manufacturing an image forming apparatus, having an envelope made of members inclusive of a first substrate and a second substrate disposed at a space being set therebetween, image forming means and spacers disposed in the envelope, the spacers maintaining the space, the method comprising the steps of:

forming a groove in a spacer base member and cutting the spacer base member along the groove to form a spacer having a desired shape; and abutting the spacer upon the first substrate or second substrate at cut surface of the spacer, wherein said step of forming a spacer having a desired shape includes a step of forming a first conductive film on surfaces of the spacer base member formed with the groove, a step of forming a second conductive film on the groove, the second conductive film having a resistance lower than a resistance of the first conductive film, and a step of cutting the spacer base member along the groove to form the spacer having the desired shape.

4. A method of manufacturing an image forming apparatus according to any one of claims 1, 2 or 3, wherein the groove has a tapered shape.

5. A method of manufacturing an image forming apparatus according to any one of claims 1, 2 or 3, wherein said step of forming a groove in a spacer base member and cutting the spacer base member along the groove to form a spacer having a desired shape includes the step of of forming a plurality of spacers having the desired shape from the spacer base member.

* * * * *